US009675220B2

(12) United States Patent
Kah, Jr.

(10) Patent No.: US 9,675,220 B2
(45) Date of Patent: Jun. 13, 2017

(54) WET/DRY, NON-POROUS BAG/BAGLESS VACUUM ASSEMBLY WITH STEAM AND VARIABLE SPEED SETTABLE VACUUM MOTOR CONTROL WITH NO LOSS OF SUCTION

(76) Inventor: Carl L. C. Kah, Jr., North Palm Beach, FL (US)

( * ) Notice: Subject to any disclaimer, the term of this patent is extended or adjusted under 35 U.S.C. 154(b) by 320 days.

(21) Appl. No.: 13/493,603

(22) Filed: Jun. 11, 2012

(65) Prior Publication Data

US 2012/0311814 A1 Dec. 13, 2012

Related U.S. Application Data

(60) Provisional application No. 61/495,674, filed on Jun. 10, 2011.

(51) Int. Cl.

| | |
|---|---|
| ***A47L 5/36*** | (2006.01) |
| ***A47L 9/00*** | (2006.01) |
| ***A47L 9/10*** | (2006.01) |
| ***A47L 9/16*** | (2006.01) |
| ***A47L 9/28*** | (2006.01) |
| ***A47L 11/34*** | (2006.01) |
| ***F22B 1/28*** | (2006.01) |

(52) U.S. Cl.

CPC ..... *A47L 5/365* (2013.01); *A47L 9/0081* (2013.01); *A47L 9/106* (2013.01); *A47L 9/1625* (2013.01); *A47L 9/1641* (2013.01); *A47L 9/1683* (2013.01); *A47L 9/2857* (2013.01); *A47L 11/34* (2013.01); *F22B 1/284* (2013.01)

(58) Field of Classification Search

CPC .... A47L 9/1666; A47L 9/1683; A47L 7/0028; A47L 7/0038; A47L 7/0042

USPC ..... 15/347, 327.4, 350, 351, 352, 353, 15/DIG. 8; 55/337, 429, DIG. 3

See application file for complete search history.

(56) References Cited

U.S. PATENT DOCUMENTS

| | | | | |
|---|---|---|---|---|
| 6,261,330 | B1 * | 7/2001 | Dyson | A47L 9/1608 55/345 |
| 6,470,597 | B1 * | 10/2002 | Stipp | D21F 5/006 34/422 |
| 2005/0132529 | A1 * | 6/2005 | Davidshofer | A47L 5/28 15/347 |
| 2008/0209669 | A1 * | 9/2008 | Kah | A47L 5/14 15/350 |
| 2009/0229071 | A1 * | 9/2009 | Fester | A47L 5/30 15/347 |
| 2012/0060322 | A1 * | 3/2012 | Simonelli | A47L 9/009 15/411 |

OTHER PUBLICATIONS

International Search Report, Jun. 11, 2012.

* cited by examiner

*Primary Examiner* — Robert Scruggs
(74) *Attorney, Agent, or Firm* — Ostrolenk Faber LLP

(57) ABSTRACT

A cyclone vacuum cleaner includes two suction fan stages, three stages of separation, plus a HEPA filter and allows capturing of wet or dry material in bag-less or bagged configuration in non-porous paper or plastic bags as well as ordinary garbage bags with pull tie tops for removal, with no suction loss. A steam generator may be added to provide substitute working vacuum fluid to the normal air for dirt pickup. Acoustic sound dumping may also be provided in the architecture of the assembly.

22 Claims, 22 Drawing Sheets

WET/DRY, NON-POROUS BAG/BAGLESS VACUUM ASSEMBLY WITH STEAM AND VARIABLE SPEED SETTABLE VACUUM MOTOR CONTROL WITH NO LOSS OF SUCTION

CROSS-REFERENCE TO RELATED APPLICATIONS

The present application claims benefit of and priority to U.S. Provisional Patent Application Ser. No. 61/495,674 filed Jun. 10, 2011, entitled WET/DRY, NON-POROUS BAG/BAGLESS VACUUM ASSEMBLY WITH STEAM AND VARIABLE SPEED SETTABLE VACUUM MOTOR CONTROL WITH NO LOSS OF SUCTION, the entire content of which is hereby incorporated by reference herein.

The present application is related to U.S. patent application Ser. No. 12/074,438 entitled CENTRIFUGAL DIRT SEPARATION CONFIGURATIONS FOR HOUSEHOLD-TYPE AND SHOP-TYPE VACUUM CLEANERS filed Mar. 3, 2008, now U.S. Pat. No. 7,996,957, the entire content of which is hereby incorporated by reference herein.

BACKGROUND

Field of the Disclosure

The present disclosure relates to an improved cyclonic separation device suitable for use with wet and dry material and a vacuum including such a cyclonic separation device.

Related Art

Cyclone dust separation devices typically include a frusto-conical (truncated cone) cyclone having a tangential air inlet at the one end having a large diameter and a cone opening leading to a dirt or dust collection area at the other end which has a smaller diameter.

There are numerous patents describing a variety of bagless vacuum cleaners now on the market by manufacturers such as Dyson, Hoover, Bissell; i.e. U.S. Pat. Nos. 5,858,038; 5,062,870; 5,090,976; 5,145,499; 6,261,330 and 5,853,440; English Patent Pub. No. GB727137; and French Patent Pub. No. FR1077243.

U.S. Pat. No. 6,261,330 discloses a device including a fan for causing fluid to flow through the cyclone separator, the cyclone separator having an inlet and an interior wall having a frusto-conical portion tapering away from the inlet, wherein the fan is positioned in the inlet to the cyclone separator chamber on the same axis thereof, such that fluid passing through the fan is accelerated towards the interior wall, and thereby, given sufficient tangential velocity to cause cyclonic separation of particles from the fluid flow within the cyclonic separator chamber. The fan motor is located on the centerline of the cyclone separator chamber, and thus, adds to the size of the cyclone separator chamber In U.S. Pat. No. 6,261,330, the inlet port arrangement and the concentric exit port connectors to the cyclone separator are not optimum. The cyclone chamber depends on gravity to keep the dirt in the bottom of the collection chamber, thus requiring the suggested alternate configuration in which the motor is connected to the fan by a long shaft that extends through the cyclone chamber to the fan at the top of the chamber. This position is not ideal for providing suction to lift dirt from the floor. The patent contends that this is an advantageous design because it lowers the center of gravity of the device as a whole when compared to the embodiment shown with the motor at the top of the vertical cyclone separation chamber.

Since many standard vacuum cleaner motors now run at very high RPM's (22,000 RPM, for example) they provide good airflow and vacuum performance with reduced weight. Having a long shaft through the cyclone separator chamber, however, as suggested by the referenced patent, would not be ideal since shaft critical speed vibration problems are likely to result, thus preventing any weight reduction options to improve the desirability of the vacuum cleaner for the public use All of the cyclonic separator type vacuum cleaners now on the market have their cyclone separator chamber on the suction side of the fan so that they are driven by the air flow that is being sucked through them. This has the advantage of only clean air being pulled through the fan impeller, but provides much less velocity and energy than would be available by placing the cyclone separation chamber on the discharge side of the vacuum fan Further, all of the cyclonic separator type vacuum cleaners described above are suitable for use only with dry material. That is, these devices are unsuitable for suctioning liquids or even wet materials.

In addition, the prior art cyclonic separation devices are typically rather loud and thus, make vacuuming an intrusive and inconvenient chore.

Accordingly, it would be beneficial to provide a cyclonic separation device that avoids these and other problems.

SUMMARY

It is an object of the present disclosure to provide a vacuum with a two-staged suction fan system that keeps the whole dirt collection system at a negative pressure even when the first stage suction fan is an open face dirty air impeller fan that discharges directly into the first stage of centrifugal separation for improved suction and separation performance with no loss of suction.

It is a further object of the present disclosure to provide a vacuum assembly that allows for the option of vacuuming with steam.

It is a further object of the present disclosure to provide a vacuum assembly with a variable fan motor speed drive to allow selective setting of the suction level for different vacuum applications.

It is a further object of the present disclosure to provide vacuum assembly with active acoustic sound damping.

A cyclonic separation device for separating particles from a fluid in accordance with an embodiment of the present application includes a particle separation element configured to separate the particles from the fluid, a particle storage element configured to store separated particles and a motor assembly including at least one suction fan configured to propel fluid including particles through the cyclonic separation device.

A vacuum device in accordance with an embodiment of the present disclosure includes a vacuum head configured to remove particles from a floor, a handle connected to the vacuum head and configured to position the vacuum head at desired positions on the floor, and a floor housing in fluid communication with the vacuum head. The floor housing includes a cyclonic separation device configured to separate particles from fluid provided from the vacuum head, the cyclonic separation device including a particle separation element configured to separate the particles from the fluid, a particle storage element configured to store separated particles; and a motor assembly including at least one suction fan configured to propel the fluid including particles through the vacuum device.

DETAILED DESCRIPTION OF EMBODIMENTS

Figure 1:
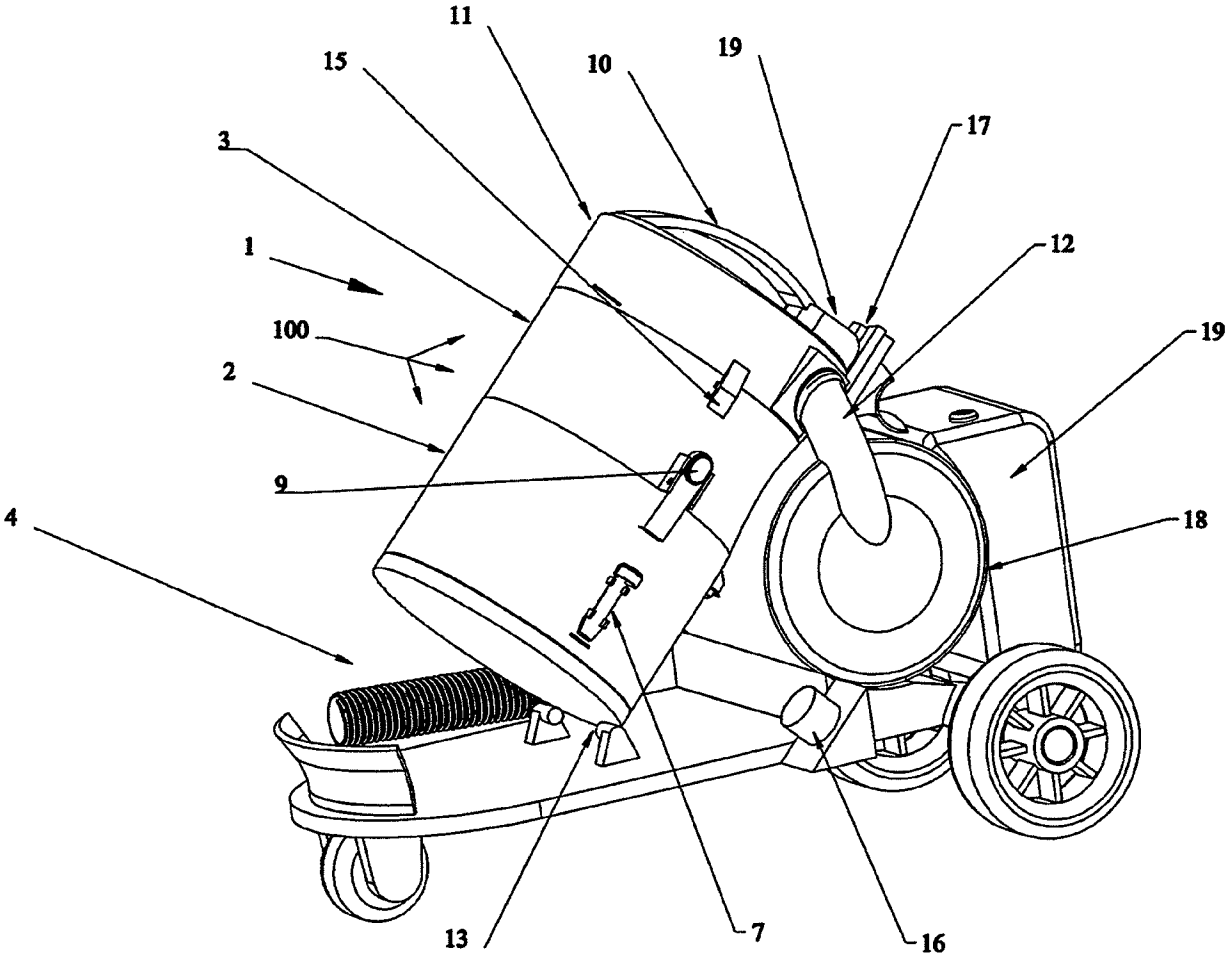
FIG. 1 shows an outside perspective view of a canister type vacuum cleaner pointing out the major operating components in accordance with an embodiment of the present disclosure.

The vacuum assembly of the present disclosure may be used as a wet/dry vacuum, may be used with a non-porous bag or in a bagless embodiment. The vacuum assembly may be used to provide steam cleaning and also allows for variable motor control with no loss of suction during operation.

A canister type vacuum cleaner assembly is shown and described herein that utilizes a separate dirt collection container where the dirt can be collected and agglomerated. This container is preferably evacuated by the suction from a dirty air impeller high speed suction fan which discharges directly into a first centrifugal dirt separation chamber at near impeller tip velocities generating very high dirt separation momentum forces and velocities.

The dirt particles exit this centrifugal separation chamber tangentially via an exit window in the chamber wall and are self compacted and agglomerated in a separate collection chamber by their own high velocity and momentum.

The air stream exiting the first centrifugal dirt separation chamber feels the suction of the second stage clean air high speed suction fan sucking on the air at a discharge end of the dirt separation system and remains at low pressure while entering into multiple smaller diameter second stage cyclone centrifugal separators to remove any remaining very small particles. The separated dirt is captured in another separate dirt collection chamber.

The air discharge from the multiple small diameter second stage cyclone separators, which exits from multiple center ducts thereof is collected and sucked through a large HEPA filter before being collected in a manifold and sucked by the second stage clear air high speed vacuum fan preferably including larger diameter, enclosed impeller vanes with more blade and a higher blade inducer angle at its center inlet, before being discharged from the vacuum cleaner. In an embodiment, it may be desired to return a portion of this air to serve as the vacuum cleaner dirt collection working fluid. In another embodiment, steam is used as the working fluid and provided to the jet assisted slots surrounding the vacuum dirt pick-up floor cleaning suction area.

The discharge from the second stage fan also passes through a sound absorption chamber sized to allow for the positioning of ¼ wave length resonant tubes in the walls thereof and including a flow resistant material over their flow exposed ends to viscously dissipate the modal sound generated by the high speed fan blades and air flow. Helmholtz-type volume resonator chambers may be added at selected locations to better absorb the lower frequency noise as well.

The airflow, or cleaning fluid, through the floor pickup head may be replaced with steam from an onboard steam generator when the vacuum operator activates a steam on switch or pull trigger on the handle. The steam may be generated by electric powered CALROD® (CALROD is a registered trademark of GENERAL ELECTRIC COMPANY CORPORATION) heating elements with a temperature limit control switch in a U-tube type container where the heating element is covered with the water from a storage chamber, but the steam, when generated, displaces the water back up to the water storage side and stops the steam generation until the steam is allowed to flow out the top of its chamber and to the slot surrounding the floor pickup vacuum opening where it is super heated relative to the vacuum environment. The heat functions to kill germs and odor from pets, for example but does not condense as water on the floor. The steam volume is preferably about 3000 times the water volume in its expanded vacuum condition and is only on when triggered by the user.

The vacuum first stage dirt collection chamber may be configured to handle wet or dry dirt and water in a nonporous bag, such as a garbage bag with pull ties, for example, or provided for bottom dumping.

The vacuum cleaner assembly shown is a canister type which has the dirt separation cyclone chamber system separable from the first dirt collection chamber if it is desired to have this first dirt collection chamber have separately removable with pull ties plastic bag.

The first dirt collection chamber may be rocked or pivoted vertically on a hinged bracket for removal of the pull tie closure plastic bag after the cyclone separation section has been slid upward out of the dirt container.

The cyclone separation system may protrude downward into the first dirt collection chamber and be sealed against the bottom of the chamber and the chamber liner plastic dirt collection bag, it may be provided to the additional separated dirt collection chambers.

When it is raised out of the first dirt collection chamber and bag, the bottom of the two subsequent dirt collection chambers may also be dumped into the plastic dirt collection bag for closure by the bag pull ties, removed and disposed of.

If a separate plastic; i.e. nonporous disposal bag is not desired, the first dirt collection chamber may remain attached to the upper cyclone separation sections and the entire separation and dirt storage assembly removed from the vacuum cleaner assembly which houses the electric two-stage fan motor, fans, sound suppression and steam generator and all of the dirt collected, dumped out of the bottom of the first collection chamber by releasing a latch and/or a spring hinged and sealed bottom closure member dropping open to allow the contents from all these stages of dirt separation to be disposed of in a garbage container.

The vacuum cleaner assembly configuration described here is suitable for use as a wet/dry shop vacuum as well.

Some of the really attractive advantages of the very intense cyclone centrifugal dirt separation produced by blowing one of the cyclone stages and having the dirt exit this cyclone chamber from an opening in the cyclone chamber wall due to its high momentum into a separate container where it can self compact and agglomerate is a reduction in the size of the vacuum cleaner with its separated dirt storage options. Dirt is not retained in the bottom of existing cyclone chamber or dropped to the bottom due to gravity.

This configuration of a cyclone centrifugal separator may be operated in any position because the dirt has such high momentum to carry it out of the sidewall opening in the cyclone chamber that self compacts and agglomerates in a separated chamber.

The present disclosure also relates to applying active acoustic liner systems in the vacuum cleaner architecture to allow applying methods for enhanced vacuum cleaner noise attenuation particularly in the relatively clean air ducts and air discharges surrounding the vacuum cleaner fan motor and suction fans, that is an acoustic liner for vacuum cleaner motor fan area and air discharges.

The noise field may be characterized as a summation of opening modal pressure patterns generated by the suction fan blades and high velocity airflow noise.

It is proposed to mold noise attenuation flexible acoustic liners in a flat form with a wall thickness as required to provide sufficient length for a ¼ wave length honey comb tube pattern configured for noise frequencies produced in a particular vacuum cleaner. For lower frequency damping below 2500 Hz Helmholtz resonance cavities may be molded into the flexible acoustic liner flat form before it is installed around the vacuum cleaner motor and fan system. A felt or filter type material covers the surface of the flexible acoustic liner to dissipate the sound energy as it echoes in and out of the tuned acoustic cavities that have been molded into the flexible sound absorbing blanket panel.

The Helmholtz equation for design is $f=(c/2\pi)[A_N(A_N V_c L_N)]^{0.5}$ where c is the local speed of sound, i.e. (1100 ft/sec); AN is the cross-sectional area of the neck hole opening to the surface of the flexible acoustic absorbing sheet (or the aggregate area of the multiple necks leading to the sound absorption surface of the sheet) as covered by the air filter material facing the vacuum motor and fans and which can provide the sound suppression reduction to the air as it moves towards the vacuum cleaner air flow exit and Vc is the volume of the chamber and LN is the length of the neck to the area of sound source.

In another embodiment, the vacuum assembly of the present disclosure includes the ability to introduce steam around the vacuum cleaner pickup head for use as the cleaning or working fluid instead of air. The steam is superheated under these vacuum conditions, and thus, can expand to large volumes at the vacuum low pressure. As a result, the steam does not condense, but rather, because of its high temperature 200°-220° F. for example, it is suitable to sterilize and destroy odors.

Vacuum pressure control of a variable speed motor for the suction fan is also provided to better stabilize airflow through the cyclone duct separation chambers to reduce pressure surge dirt separation disturbances.

Also, the vacuum assembly's suction flow may be reduced when using steam and its flow is restricted to reasonable quantities by the sizing of the steam slots surrounding the vacuum's pickup opening.

The vacuum assembly of the present disclosure includes a cyclone centrifugal separator that can be blow or suck, and that can be operated in any position since it does not depend upon gravity to settle the dirt since the dirt exists the cyclone centrifugal chamber through an opening in the wall of the cyclone chamber and is preferably directed into another dirt collection chamber where it is self compacted and agglomerated due to its high momentum relative to the air in the chamber.

Referring to FIG. 1 of the drawings, a canister type vacuum cleaner assembly 1 is shown with its major operating elements. The assembly 1 includes a bottom dumpable initial dirt container 2 which is attached by latch 9 to upper fine dirt separation stages housed in section 3 which includes a first cyclone centrifugal separation stage for small dirt separation which is blown by the discharge from an open bladed first stage suction fan that provides the suction in the first stage dirt collection container 2.

Multiple second stage cyclone centrifugal separation chambers having a smaller diameter surround the central cyclone separation chamber. Cover 11 serves as the second stage suction fan manifold to collect the discharge from the multiple second stage cyclone separate chambers and houses a HEPA filter through which vacuum cleaners work air or steam through before reaching the second stage high suction large diameter shroud enclosed shrouded impeller.

Figure 2:
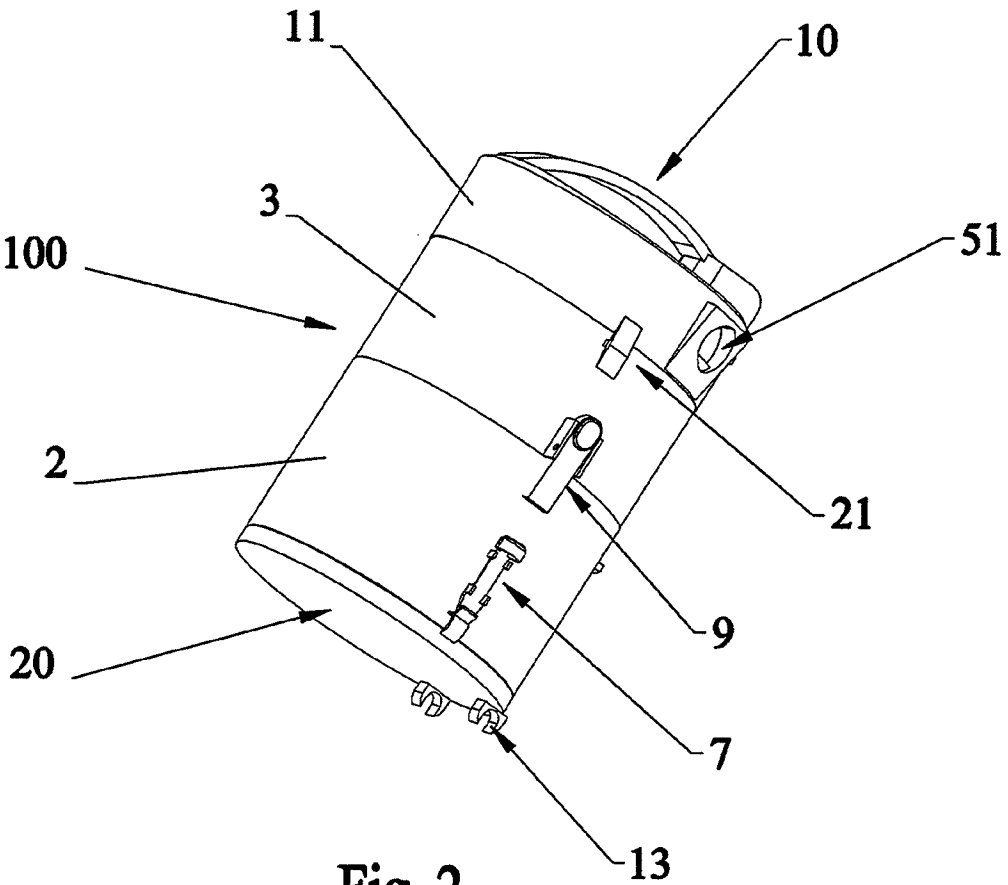
FIG. 2 shows an outside perspective view of a detached dirt collection and separation assembly of a vacuum assembly in accordance with an embodiment of the present disclosure.

Item 10 is a handle for handling the dirt collection and separation assembly 100 which is shown separately in FIG. 2.

Figure 4:
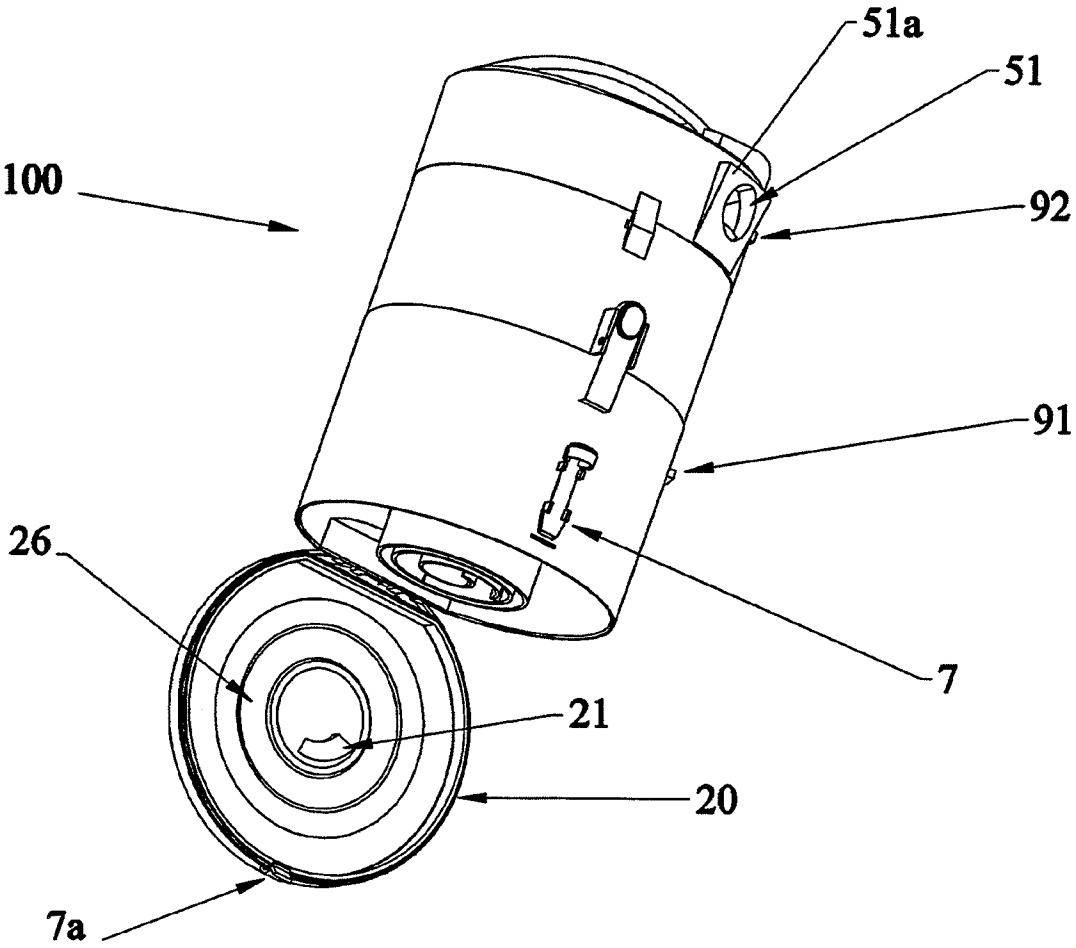
FIG. 4 shows the dirt collection and separation assembly of FIG. 2 with its bottom dirt dump cover in the open position in accordance with an embodiment of the present disclosure.
Figure 5:
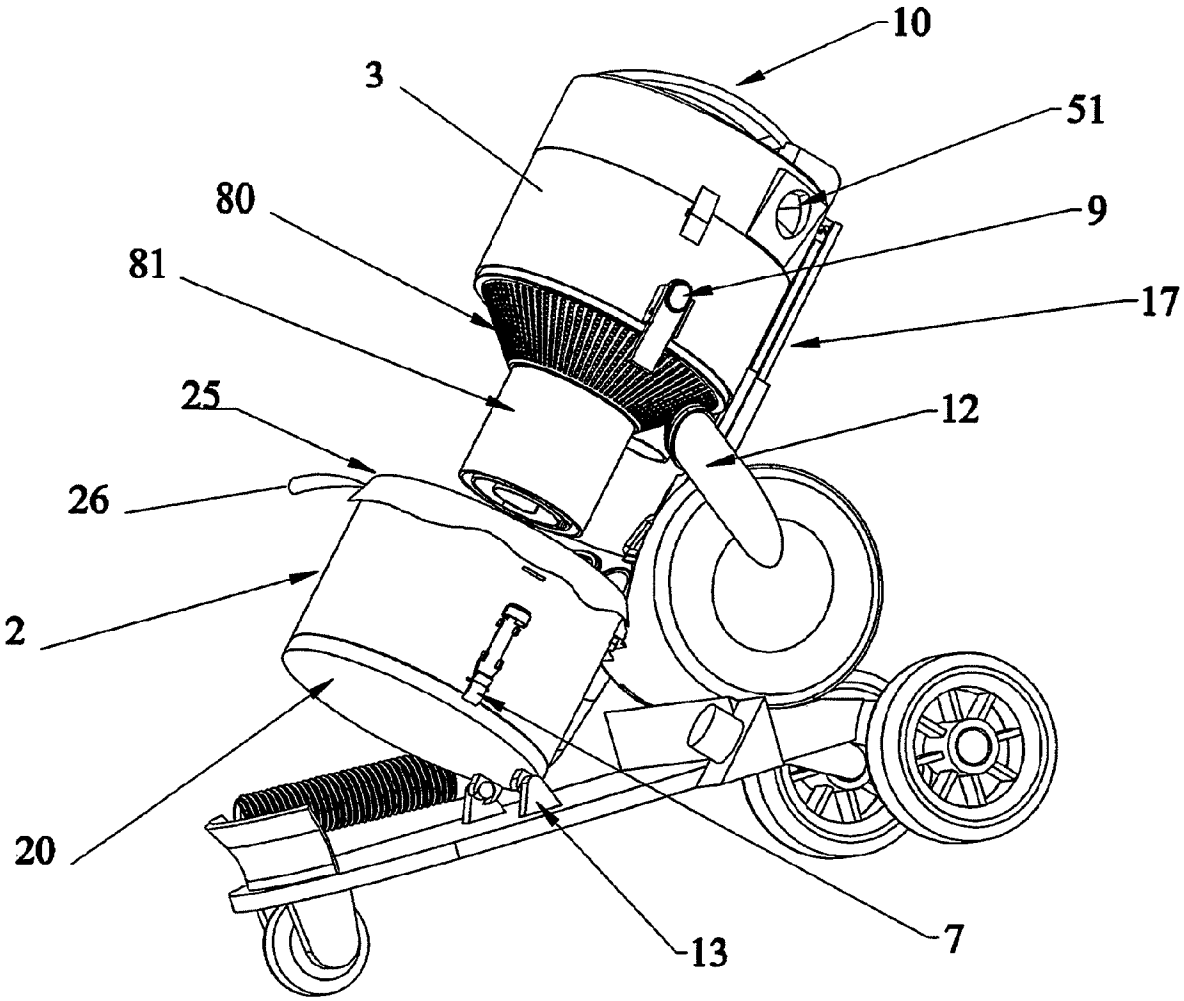
FIG. 5 shows an outside perspective view of the vacuum cleaner carriage with the dirt separation section slid up out of the dirt collection chamber in accordance with an embodiment of the present disclosure.

Handle 10 may have at its top end a release latch 19 which allows it to release assembly 100 (including elements 2, 3, 11) from the carriage assembly 200 and up slide rail 17 as shown in FIG. 1 so that it can be handled separately as shown in FIG. 2, FIG. 4 and FIG. 5.

Figure 1A:
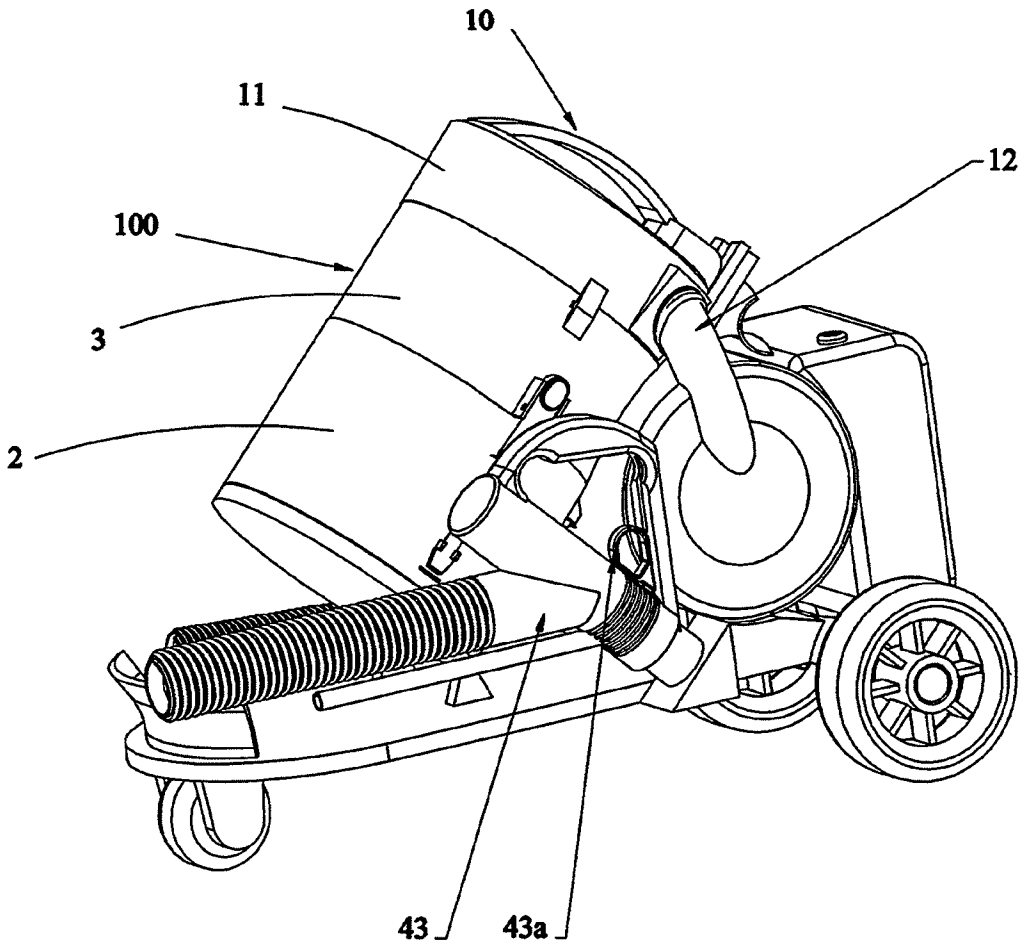
FIG. 1A shows the same view as FIG. 1 with the vacuum hose handle plugged into its storage position on the carriage.
Figure 1B:
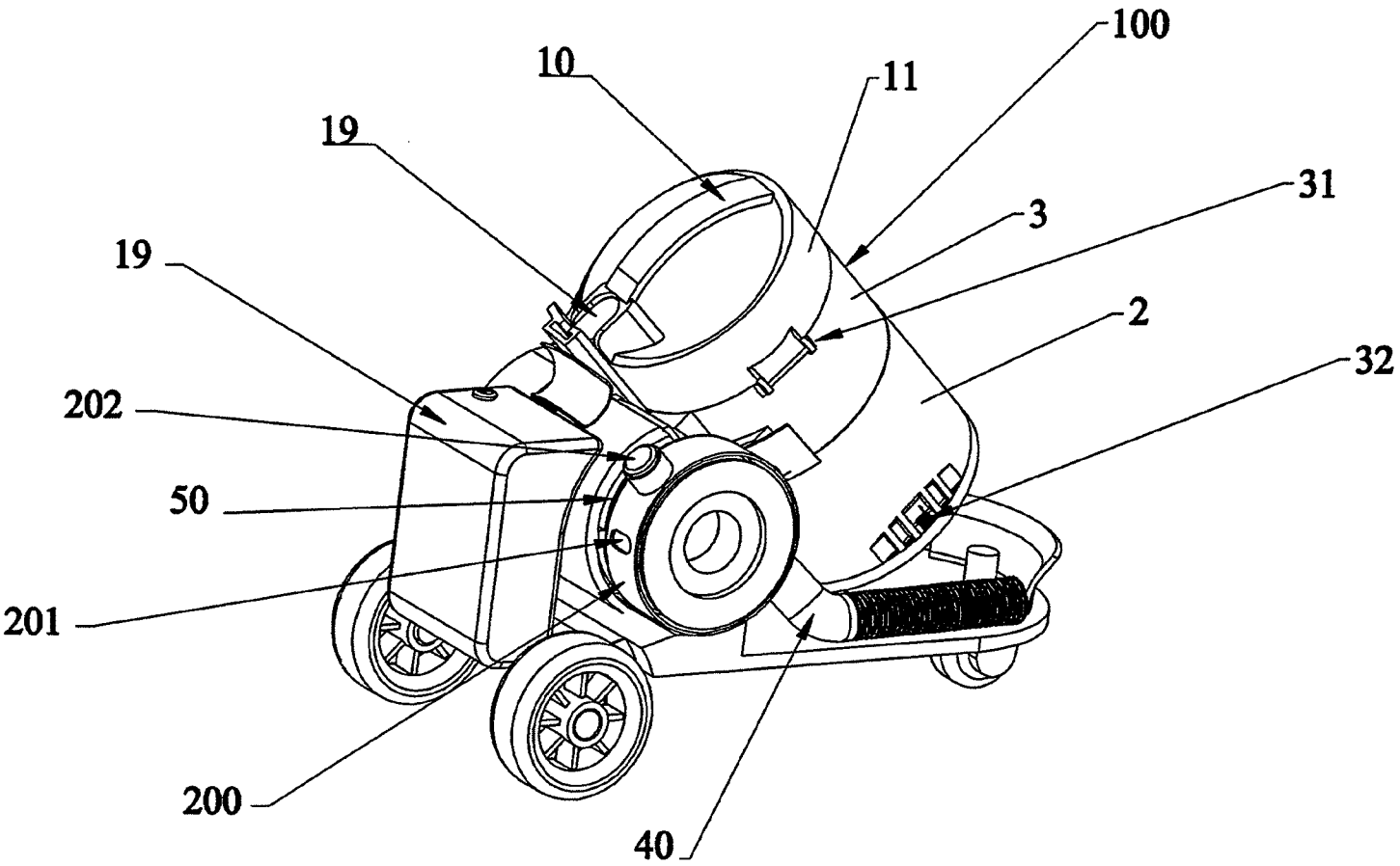
FIG. 1B shows the vacuum cleaner assembly from the opposite side as that shown in FIG. 1A.
Figure 1C:
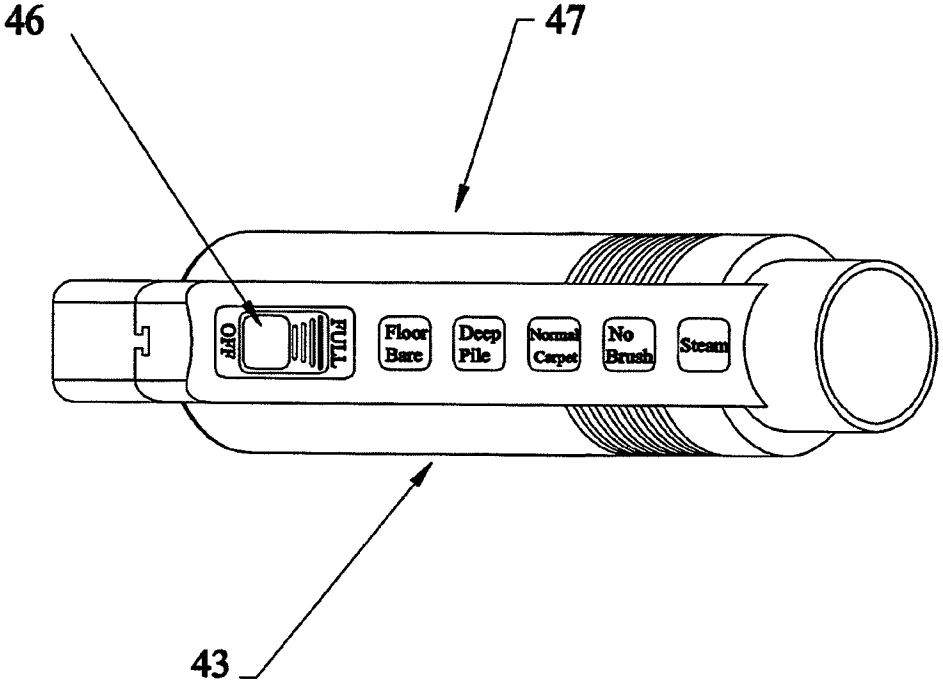
FIG. 1C shows the vacuum cleaner function control buttons located on top of the vacuum hose handle in accordance with an embodiment of the present disclosure.
Figure 13:
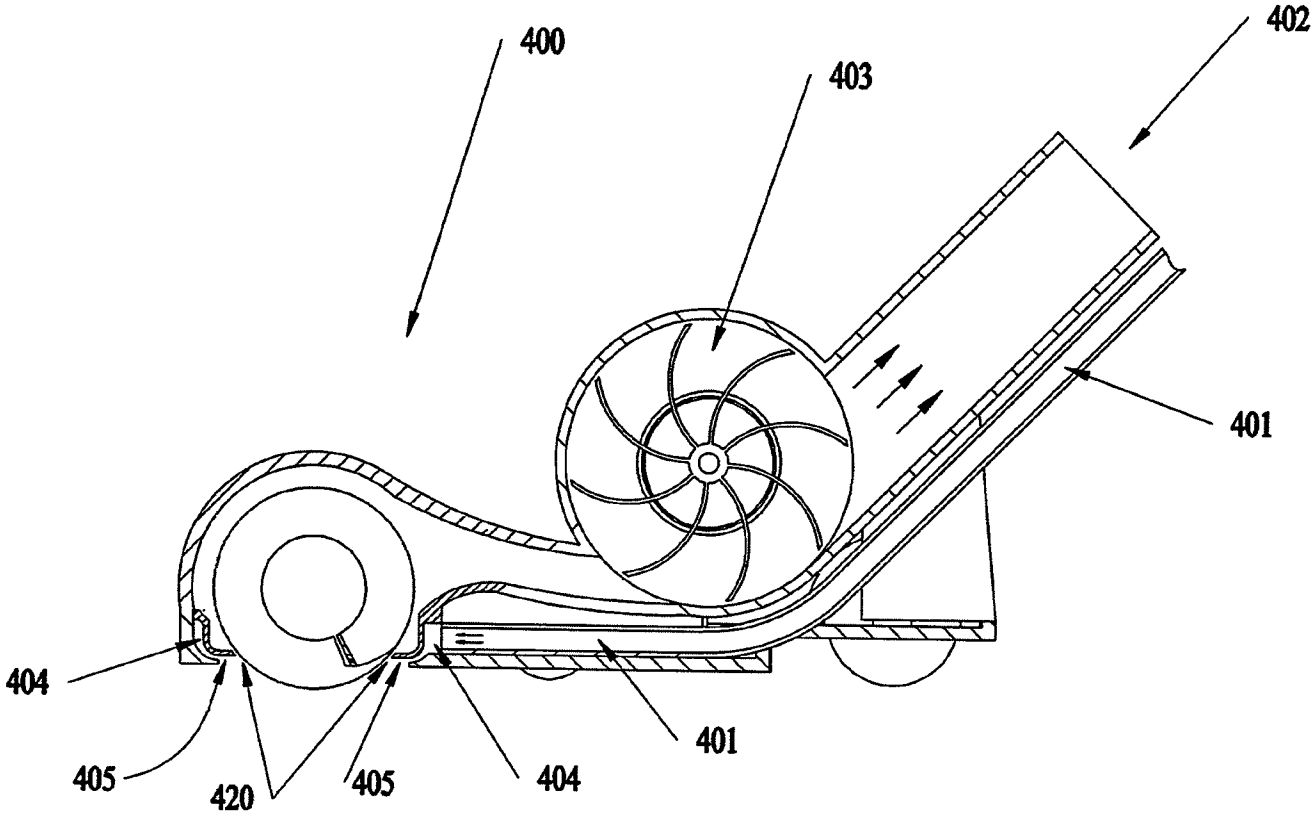
FIG. 13 shows a carpet sweep, power brush suction head assembly in cross-section showing the details of the dirt pickup suction opening and surrounding steam slot.

Also shown in FIGS. 1A and 1C is the suction hose operator handle 43 with its top-side motor speed control and function selection buttons as well as a steam trigger to cause steam to flow to the floor pick-up head 400 as shown in FIG. 13, for example.

Figure 3:
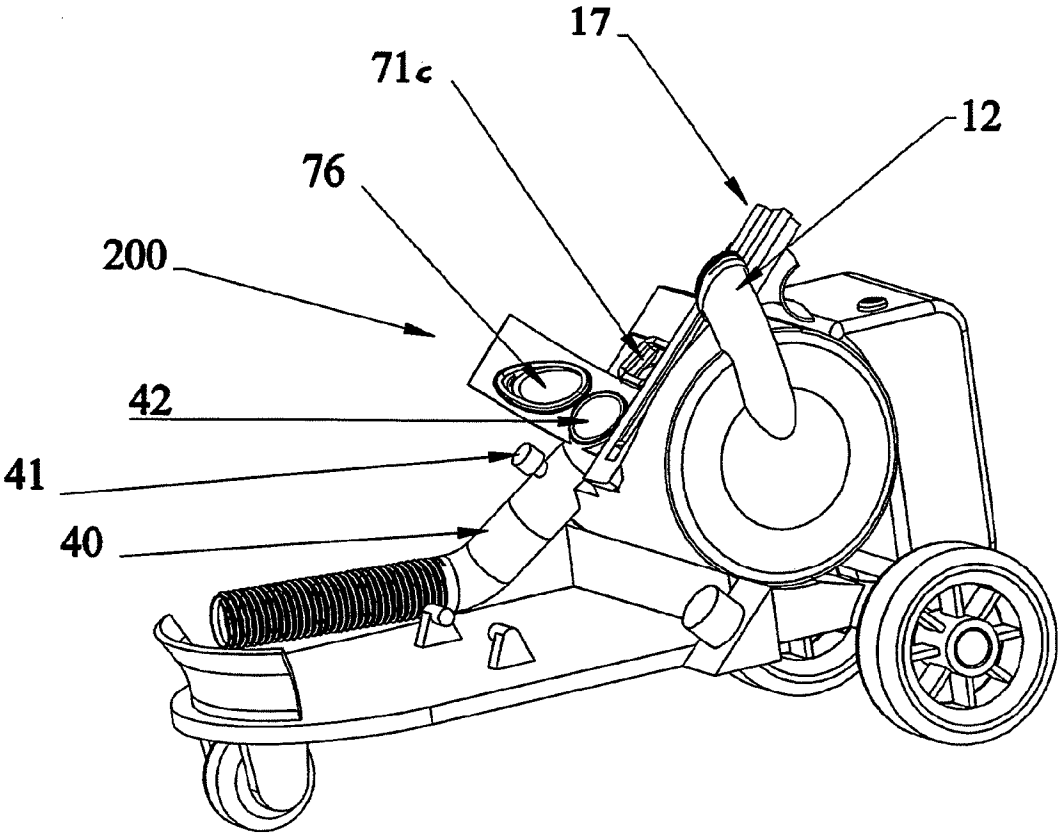
FIG. 3 shows an outside perspective view of a floor model carriage which houses a two stage suction fan, motor cooling fan, active sound suppression chamber, air discharge, electric cord real and removable steam generator assembly with a dirt separation and collection chamber removed in accordance with an embodiment of the present disclosure.

The vacuum cleaner floor carriage 200 is shown in FIG. 3 with the dirt container and separation assembly 100 removed as if to be carried for dumping from its bottom, see FIG. 4, for example.

The vacuum cleaner assembly 1 of the present application may be embodied a canister type vacuum for use inside homes, or a shop vacuum or wet/dry vacuum in a smaller version for boats, for example. The floor carriage assembly 200 has a two-stage suction motor suction fan assembly 12 that is close connected to the inlet and outlets of the dirt collection and separation assembly 100 of FIG. 2.

The vacuum hose connection to assembly dirt collection and separation assembly 100 is preferably via opening 44 (see FIGS. 7 and 8) to be directed downwardly into dirt collection chamber 2 by elbow and passage 43, for example.

All connections to the dirt collection and separation assembly 100 preferably include vacuum lip seals that mate with the function opening, preferably at a 10° angle, see element 51*a* of FIG. 4, for example, which is the $2^{nd}$ stage high suction fan inlet connection through line 12. See also FIG. 3.

Figure 4A:
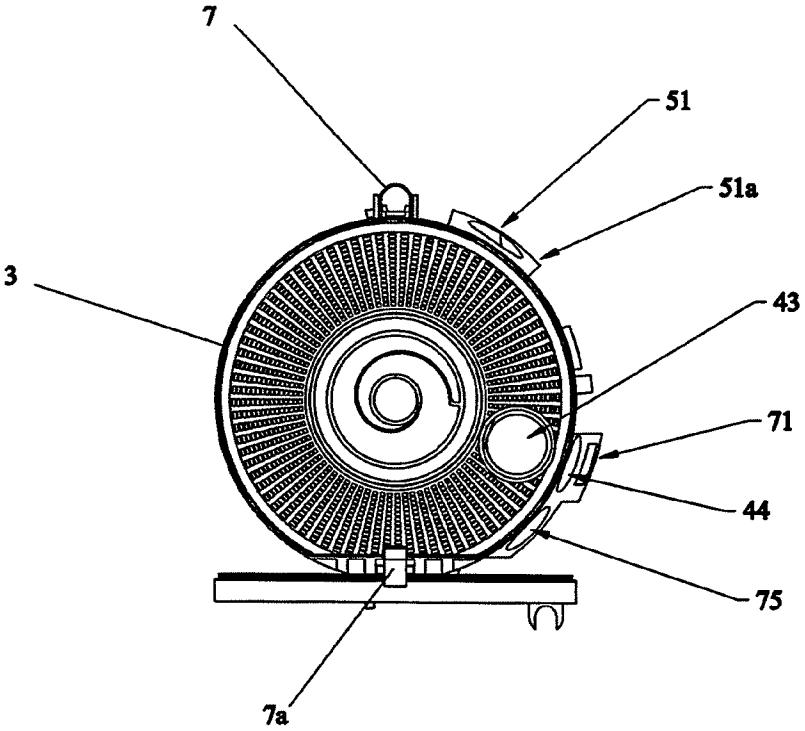
FIG. 4A is a view looking directly axially up into the bottom of the dirt collection chamber and the centered dirt separation cyclone bottom and surrounding large dirt air strainer that is above the dirt collection chamber in accordance with an embodiment of the present disclosure.

The angled seats for all connecting lines, see FIG. 4A, allows the separation assembly 3 as shown in FIG. 5 to be slid upward on track 17 to allow withdrawal of the second and third stage separation and collection chambers from the first dirt collection chamber 2.

Figure 7:
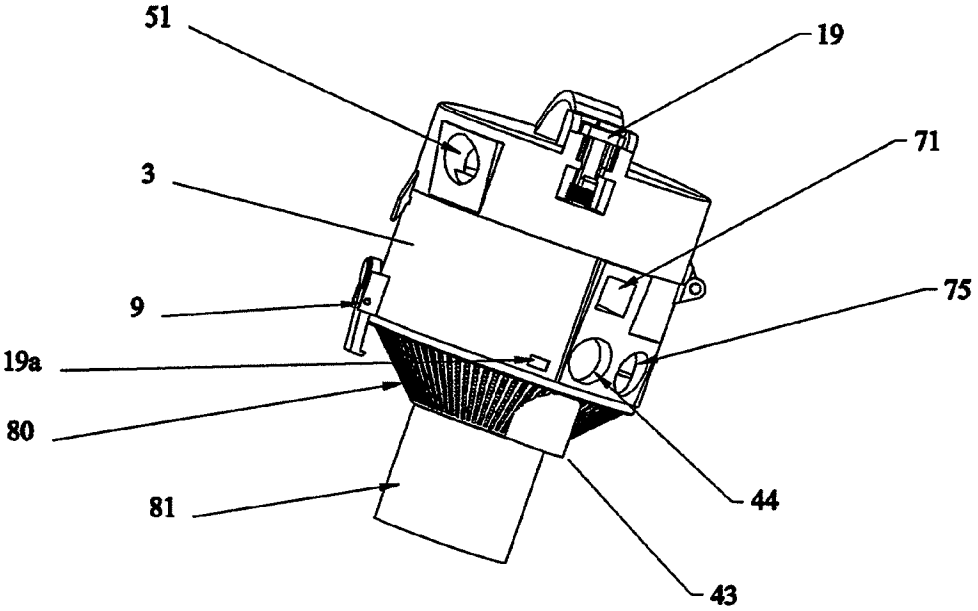
FIG. 7 shows the dirt separation assembly removed from the carriage and with its dirt collection chamber removed in accordance with an embodiment of the present disclosure.

The dirt collection and separation assembly may also be released from the track 17 by latch button 19 shown in FIG. 7, for example, so that it may be separately handled as previously explained and shown in FIG. 2 and FIG. 4.

Thus, the dirt collection and separation assembly 100 may be rocked or pivoted up around bottom hinge points 13 after pushing latch 19 and lifted free as shown in FIG. 2 for dumping, see FIG. 4, or its upper dirt separation sections 3 and 11 may slide up along track 17 after pushing dirt collection container release latch 9 leaving the dirt container 2 on the carriage assembly as shown in FIG. 5, for example.

Figure 6:
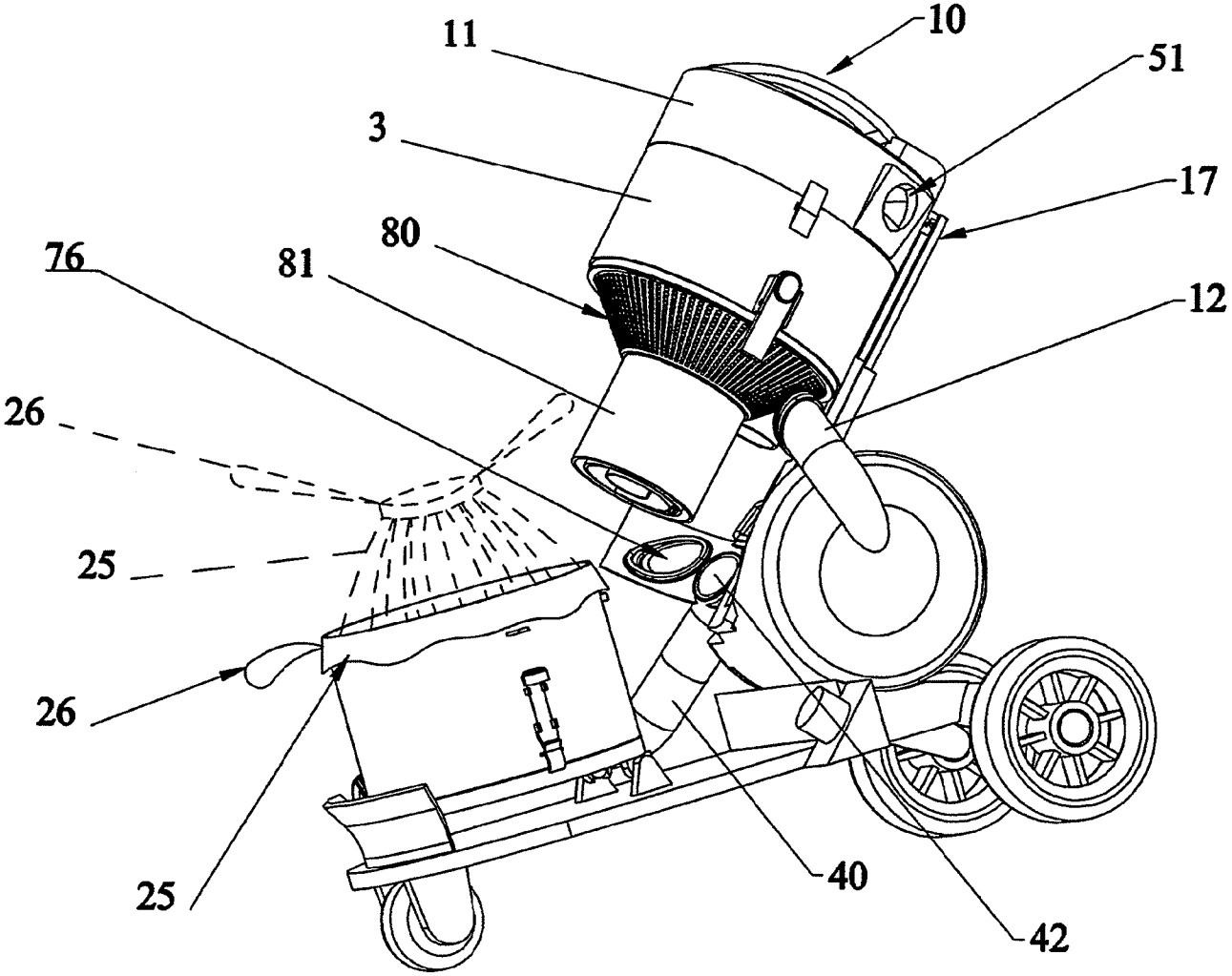
FIG. 6 shows the dirt collection chamber rocked or pivoted vertically to allow lifting a nonporous plastic dirt bag with pull ties out of the dirt collection chamber in accordance with an embodiment of the present disclosure.
Figure 8:
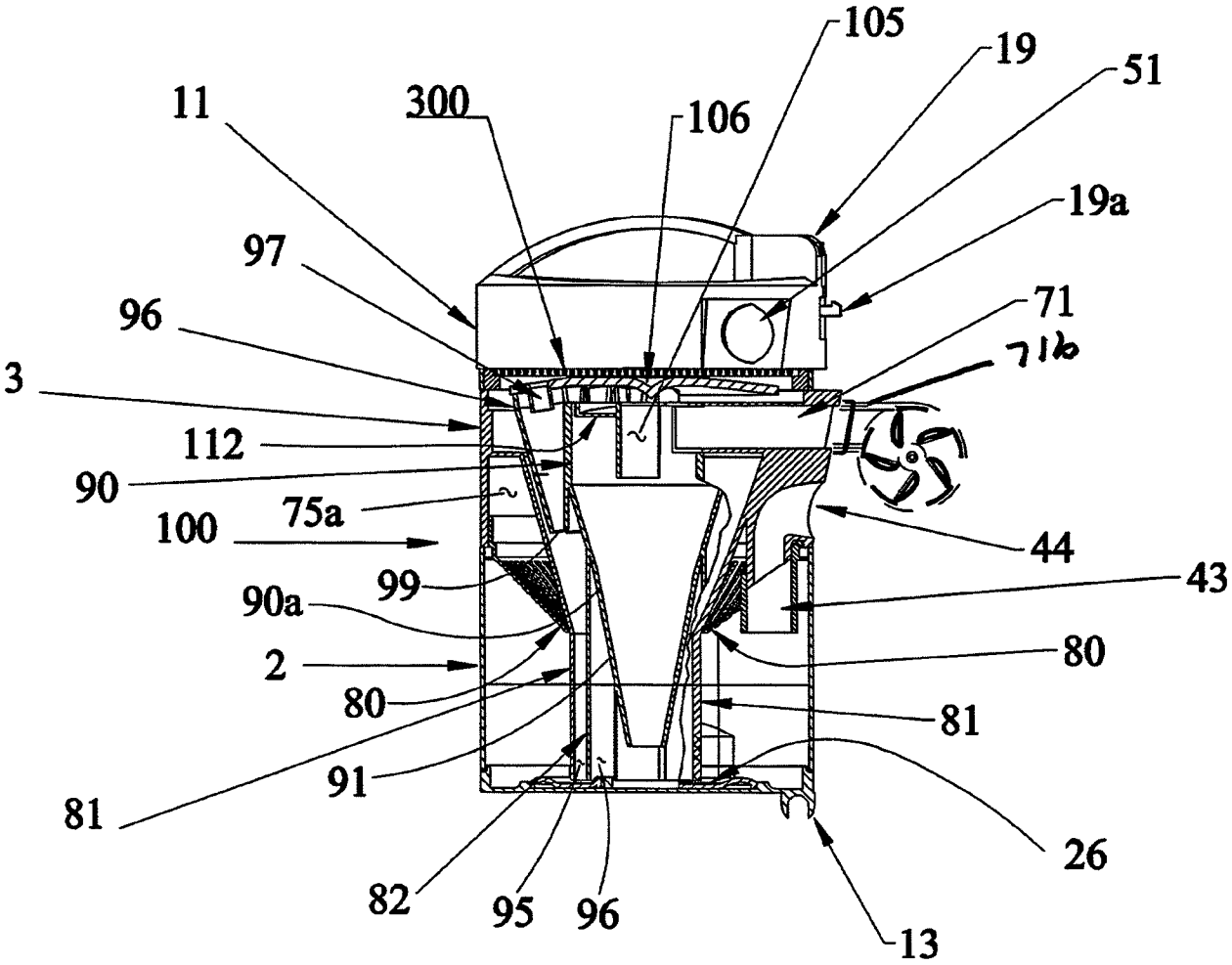
FIG. 8 shows a cross section of the dirt separation and collection chamber assembly (see section 8.8.) as shown in FIG. 9. The dirty air suction fan is shown in phantom with its discharge connected to the first stage cyclone tangential inlet.
Figure 9:
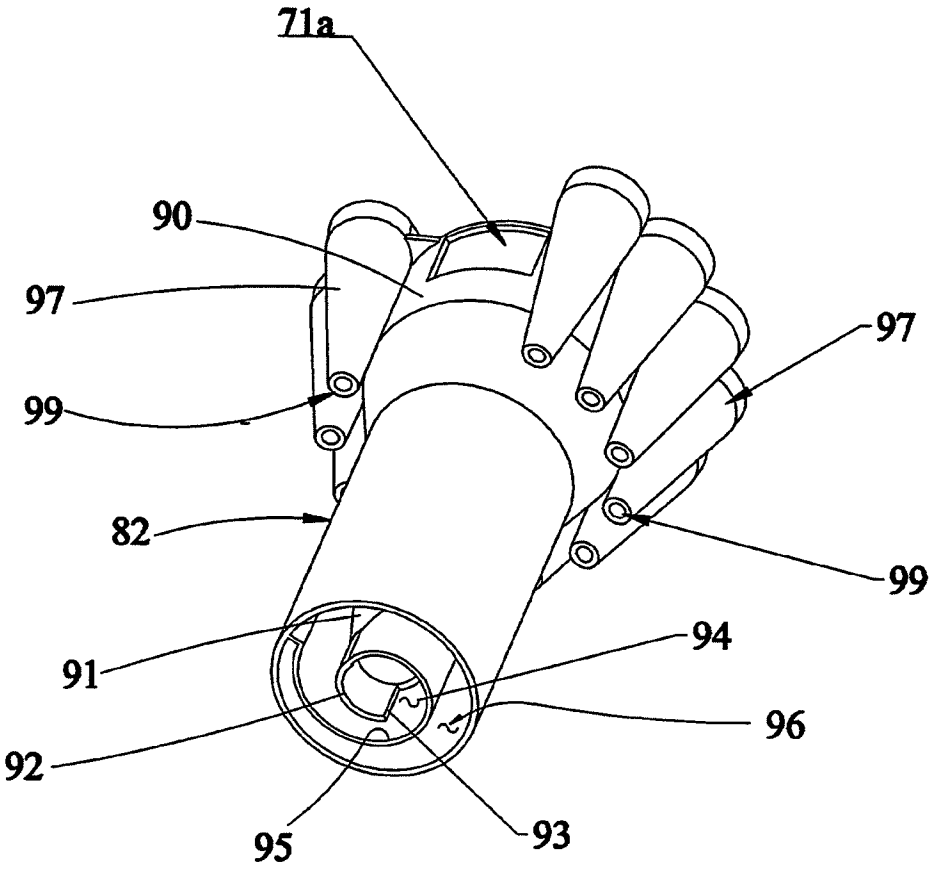
FIG. 9 shows a perspective view, with its surround second stage cyclone chambers of the bottom of the first stage cyclone chamber's tangential dirt discharge window in accordance with an embodiment of the present disclosure.

Once the lower second and third dirt collection chambers of section 3 of the dirt separation assembly 100 are withdrawn, the dirt collection chamber 2 including nonporous bag 25 as shown in FIG. 5 may be rocked or pivoted up as shown in FIG. 6 to allow easy removal of the pull-tie throw-away bag 25. The housing 81 is the outside housing of the third dirt collection chamber for the dirt separated and discharged from the small diameter second stage cyclone chambers at their bottom dirt exit holes 99. Each of these cyclones, as can be seen in FIG. 8 for example, settles in chamber 95. The dirt from the first stage blown cyclone chamber is self compacted by its very high velocities and momentum after exiting cyclone chamber 90 at its bottom dirt discharge wall opening 94 in its lower cone section 91 as can be seen in FIG. 9, for example.

Thus, all three stages of separated dirt end up in separate compartment within dirt collection container 2. The center two chambers 95 and 96 are surrounded by the cylindrical wall 81 which extends down from the outer housing of section 3. They are closed at the bottom by a flexible cylindrical piece 26 in the bottom cover 20 of dirt collection container 2. When the bottom dirt cover 20 is unlatched by latch 7 it is spring loaded to flop downwardly to open by hinge coil spring 32 which can be seen in FIG. 1B, for example.

The flow path through the dirt collection and separation assembly 100 as shown in FIG. 8 starts with the dirt from the vacuum cleaner suction hose 40 arriving at the floor carriage assembly which houses the motor and suction fans and is connected to the dirt collection and separation assembly 100 at vacuum sealed connection 42 as seen in FIG. 6 and FIG. 3. Thereafter it connects to opening 44 in the side of assembly 100 and is routed through passage 43 and directed down into the dirt collection container 2 (FIG. 8). This outer circumferential volume is three times larger than the central cylindrical second and third stage storage volumes 95 and 96 encompassed by cylindrical member 81, which is part of the outer section 3 housing. This is because the area and volume increase as the square of the radius so that the dirt container 2 has a significant storage volume compared with bag less vacuum cleaners now on the market and the dirt is stored in separate chambers where the dirt is not swirling and the dirt can agglomerate compared to other cyclone separation bag less vacuum now on the market. Also, the vacuum assembly may be configured as wet or dry vacuum and may use nonporous bags and or be used as a bag less device.

The suction on dirt collection chamber 2 is through the large dirt separation screen 80 which is shown as a large area conical screen 80 which draws the air up into area 75*a* that surrounds the entire upper side of large dirt particle screen 80 in separation housing 3. This suction on this area 75*a* in separation housing 3 is created by the first stage open face impeller 505 dirty air fan 504 shown FIG. 15 and FIG. 16. The suction side of the first stage suction fan is connected to the chamber 3 area 75*a* by connection, FIG. 15, and vacuum seal lip connect 76, FIG. 3, through hole 75, shown in FIG. 3.

The first stage suction fan discharges directly through duct 71*b* (see FIG. 15) to vacuum lip seal connection 71*c*, shown in FIG. 3, for example, to separation chamber 3 inlet port 71, see FIG. 7. Then through connecting port 71*a* and into the first cyclone centrifugal separation chamber 90 being turned and contained by the inside wall surface 90*a*, see FIG. 10. The lower portion of this cyclone separation chamber is an inverted cone sidewall identified as 91 in FIG. 8 and FIG. 9. At its bottom there is an opening in the side wall of the cone 91 and 94 as you advance clockwise in this view of FIG. 9 from the cone side wall at the bottom of the cone 91 identified as 92 which portion of the seal off against the bottom of the dirt collection container door 20 rubber member 26. The spiraling surface 95 channels the high velocity dirt particles exiting the cone to dirt collection area 96, see FIG. 8 and FIG. 9, where it is self compacted by its high momentum and since the pressure here is very low due to the cyclone central pressure having been reduced for the high velocity acceleration of the flow of dirt and remaining air (such as in a hurricane). Since this bottom dirt collection area cannot continue to swirl the dirt became very still and agglomerates in chamber 96. Much more stable than if the dirt exiting the bottom of the cone of the first stage cyclone chamber had been allowed to swirl out on all sides of the exit at the bottom as in other cyclone separation vacuum cleaners now on the market.

There is a small ramp area 21 at the bottom of cyclone dirt exit area 94, see FIG. 4 and FIG. 9, that kicks any dirt flow along the bottom surface of 26 up against the deflecting spiral wall 95 to allow it to be compacted further around the circumference into collection chamber 96.

Figure 11:
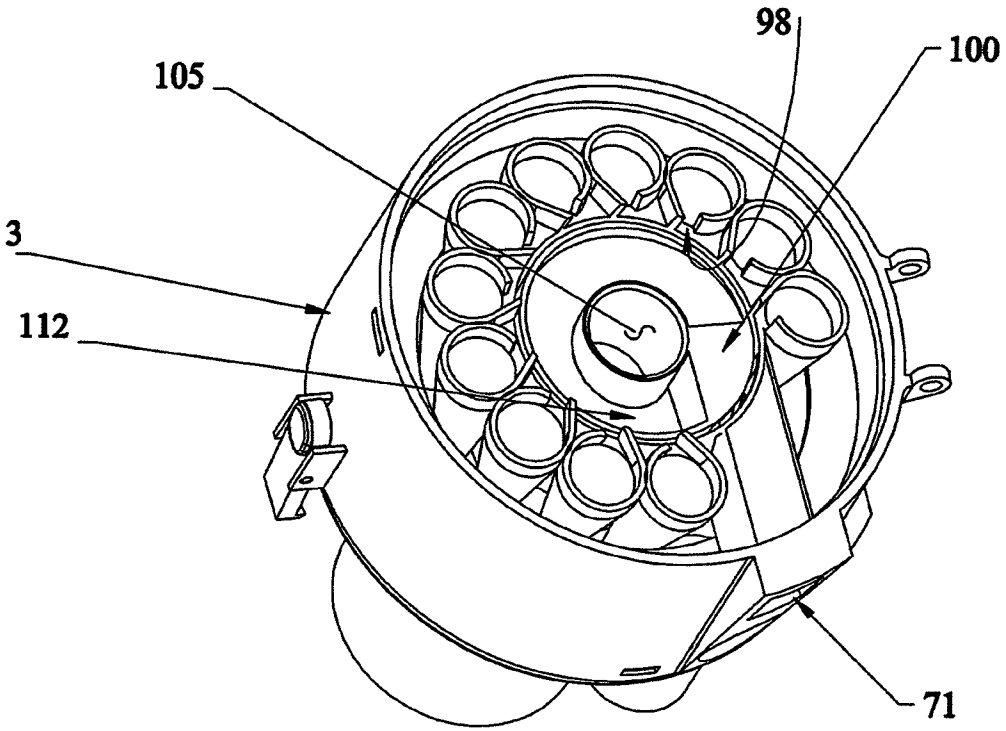
FIG. 11 shows the same view as FIG. 10 but with the first stage center cyclone chamber cover plate with its center exit air hole for the multiple second stage cyclone chambers installed.

As shown in FIG. 11 there is an insert top for cyclone chamber 90 at the top, which has a spiral, stepped downward surface 112, which directs the high velocity fan discharge dirty air from inlet 71 downward at an angle to miss the incoming flow at 71*a* as it has rotated 360°.

This surface 112 initiates the downward movement of the dirty air and centrifugal separated dirt around the inside of the chamber at wall 90*a* surface downward into the lower cone area of the chamber 91 where the velocity of the flow continues to increase by its vortex type cyclone flow (same as in a hurricane where the center pressure is very low due to the conversion of static pressure to kinetic velocity energy). The air is contained by wall 91 so the dirt is contained on the wall until it reaches the bottom where the remaining air pressure and density is very low and when it reaches the opening in wall 91 at wall 92 as shown in FIG. 9 it exits tangentially as deflected by spiraling outward surface 95 and directed into the dead ended collection chamber 96 where it is self compacted and agglomerated, does not continue to swirl with minimum air flow disturbance.

Figure 10:
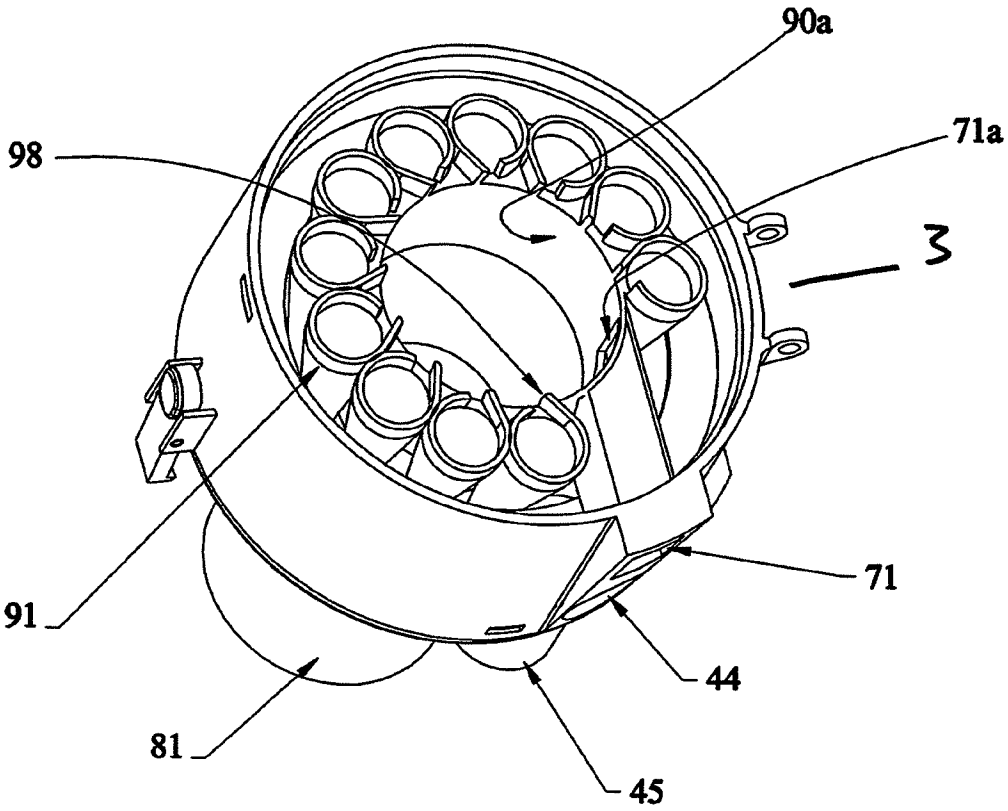
FIG. 10 shows a top perspective of the dirt separation assembly with a top cover, HEPA filter, center cyclone chamber cover, and secondary cyclone chamber cover removed.
Figure 14:
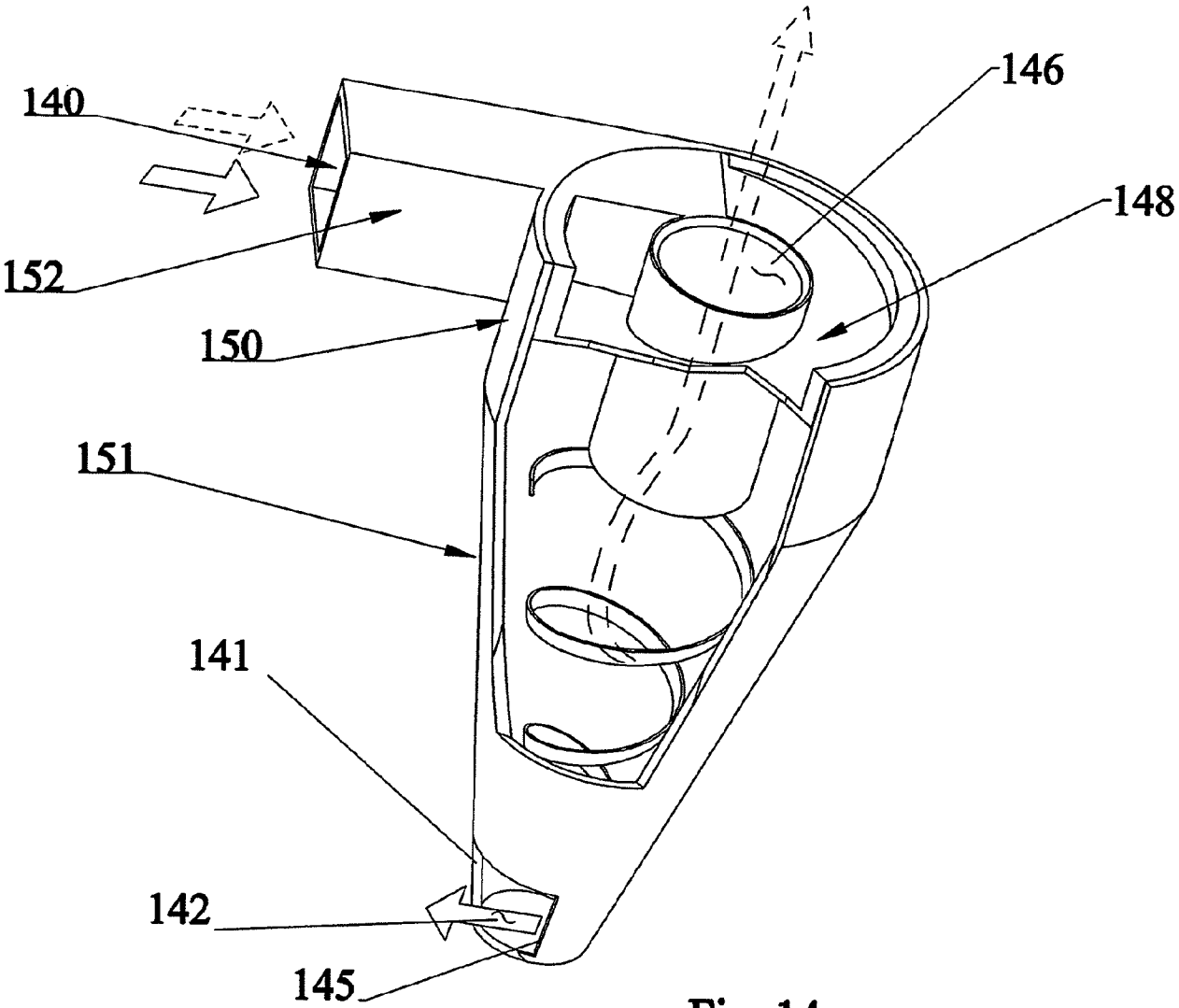
FIG. 14 shows a perspective schematic type view of a basic pressure or suction driven cyclone centrifugal separator where the dirt exits the cyclone chamber tangentially through an opening in the cyclone chamber wall and may be directed due to its own momentum into a separate chamber and self compacted in the separated chamber by its own momentum.

Another configuration of this is shown in FIG. 14 where this figure is drawn with the flow in this cyclone chamber 150 being shown in a clockwise direction as seen from the top instead of a counterclockwise direction as for chamber 90 of FIG. 10 and FIG. 11 as viewed from the top. When viewed from the bottom it is clockwise for explanation of bottom discharge looking into bottom of chamber in FIG. 4.

An advantage of the vacuum assembly of the present disclosure is that it allows the dirt at the outside circumference of the cyclone chamber to be discharged out an opening in the wall of the cyclone chamber as it then can move itself to another chamber where it can be stagnated and the cyclone chamber can remain small in diameter and also allow it to be directly blown by the suction fan discharge at near impeller tip velocities since the dirt once it is allowed to escape the cyclone chamber tangentially can be stagnated in another chamber and compacted by its own momentum instead of being continually stirred by a rotating swirling discharge flow from or in the lower cyclone chamber.

This allows the size of the separation system to be much smaller and to be operated in any position. It does not rely on gravity to settle the separated dirt as us common in the prior art. The air exits the first cyclone separation chamber 90 through center opening 105 in the chamber top cover 100 as defined by downwardly spiraled surface 112 (also, see cross-section FIG. 8).

Figure 15:
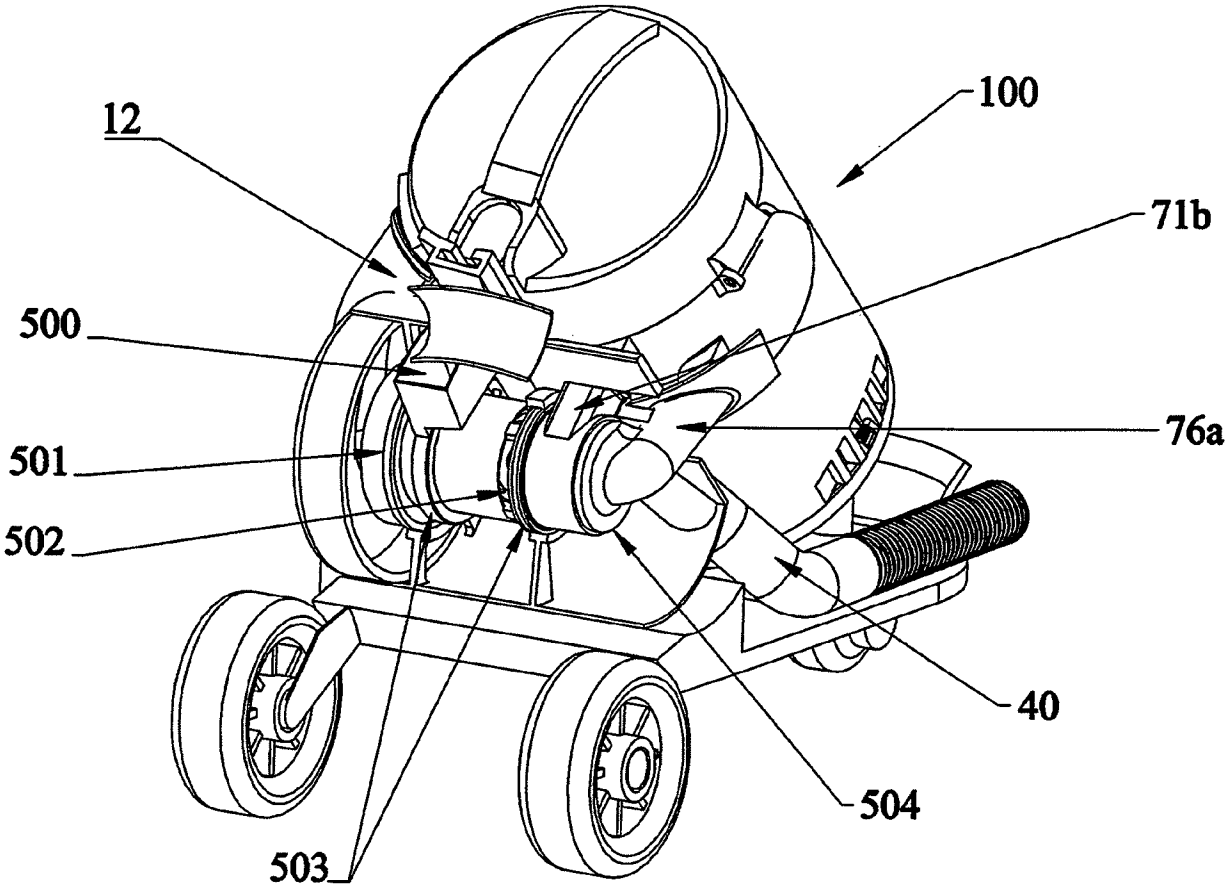
FIG. 15 shows a perspective view of the rear of the canister vacuum cleaner assembly with its fan motor cover sound absorption chamber removed in accordance with an embodiment of the present disclosure. Detail components are identified.
Figure 16:
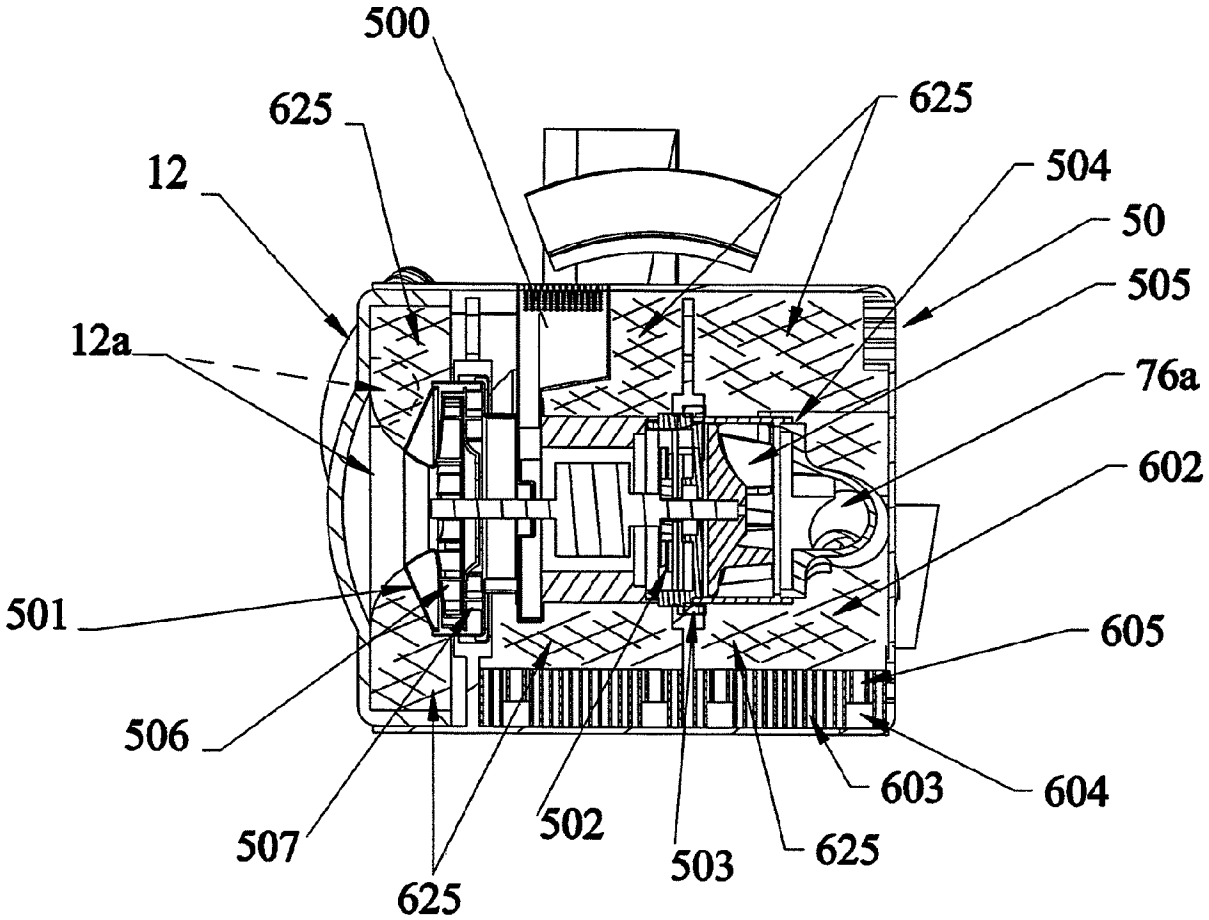
FIG. 16 shows a cross-section of the two stage suction fan motor assembly pointing out key components in accordance with an embodiment of the present disclosure.

It flows upward as sucked by the final suction stage fan 501, see FIG. 15, and its impeller 506 and discharge velocity diffuses 507, see FIG. 16, through passage tubes 12 and 12*a*.

The flow from the center exit area 105 strikes the cone deflector at 106 on the cover 115, see FIG. 8, and is diverted into the surround multiple small cyclone chamber 96 at each of their tangential inlet 98 as shown in FIG. 11.

Figure 12:
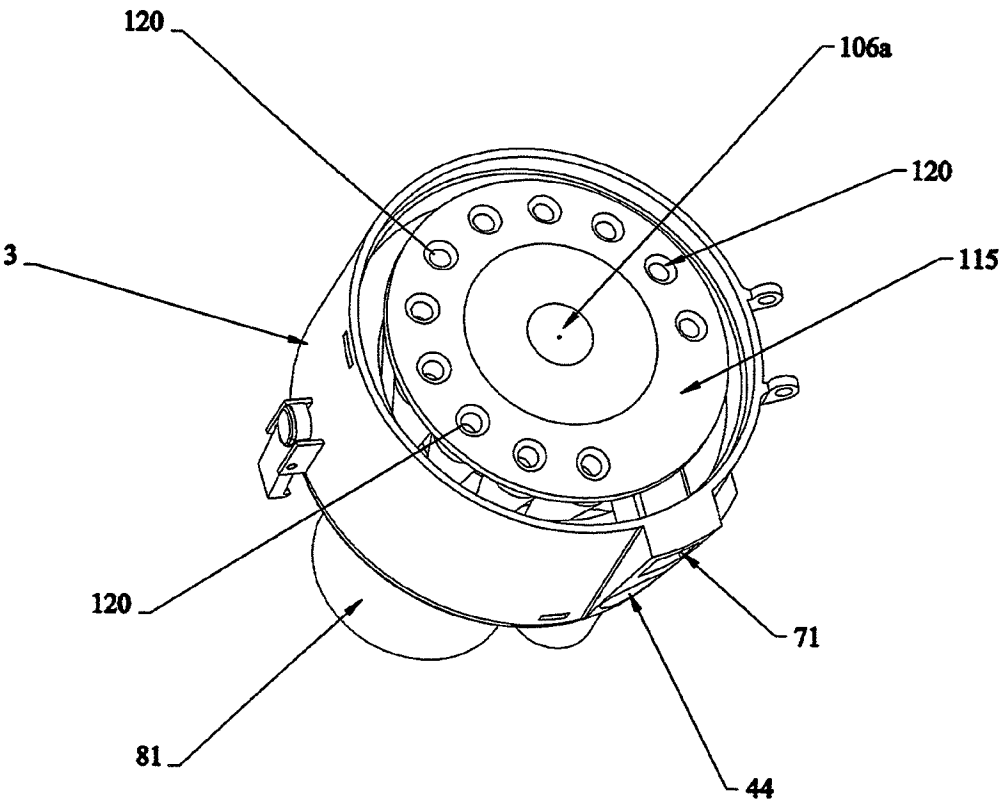
FIG. 12 shows the same view as FIG. 11 but with the second stage cyclone chamber cover installed over the second stage cyclone chamber showing their center air discharge holes.

The air exits these multiple cyclone chambers through their center exit tubes 120, see FIG. 12, for example.

As shown in FIG. 8 the flow now is sucked through HEPA filter 300 as shown in FIG. 8 and exits the filter into the separation section cover 11 air collection chamber where it is connected to the second stage suction fan 501 through port 51 and suction line 12 as shown in FIG. 1, FIG. 16 and FIG. 15.

In FIG. 12 the top cover 115 has been added over the top of the multiple smaller cyclones as shown in FIG. 11.

All of the vacuum suction air or steam is sucked through the first stage suction fan 504, see FIG. 15, then blown by it at high velocity into the first cyclone separation chamber 90, then discharged through that first cyclone chamber center exit tube 105 at the top into the inlets 98 (FIG. 11) of the second cyclone separation multiple surround cyclone chambers where the air (or steam) exit through their center exit tubes 120 and is drawn through the HEPA filter 300 enclosed by the hinged and snapped top 11. The total suction power is the result of the combined effort of both suction fans to be discharged through the second stage suction fan stator diffuser 507, see FIG. 16, into the surround sound absorption area provided by the sound absorption fiberglass filter material, see FIG. 17, with its felt and ¼ wave length and Helmholtz resonance cavities.

The air is discharged out the side vent 50 as shown in FIG. 16. Also of note is the separate motor cooling air inlet and filter and sound damping at 500 shown in FIG. 15 and FIG. 16. The motor cooling air has a separate fan 502 which discharges into the same sound damping area.

This ensures that the motor is not damaged by any fumes or heat from the steam or water for the wet/dry vacuum.

In FIG. 13 the carpet sweep power brush suction head assembly is shown in cross-section showing the details of the steam line 401 connection to steam manifold 404 surrounding the pickup suction opening 420. The jet-assist slot 405 can be used for steam injection surrounding the suction and rotating brush opening 420 so that when the steam trigger 43*a* is activated on the operator handle 43 it can completely replace the air working fluid used for dirt pickup if the suction does not exceed the steam supply. Thus if it is planned to use steam it can be advantageous to select a motor speed and suction level as selected for steam by a push button on the top of the operating handle 47 as shown in FIG. 1C. The suction motor speed can be controlled by the pressure sensor 41 as shown in FIG. 3 on the vacuum cleaners inlet hose line to the first dirt container. That is air or steam may be used as the cleaning fluid if desired.

Figure 18:
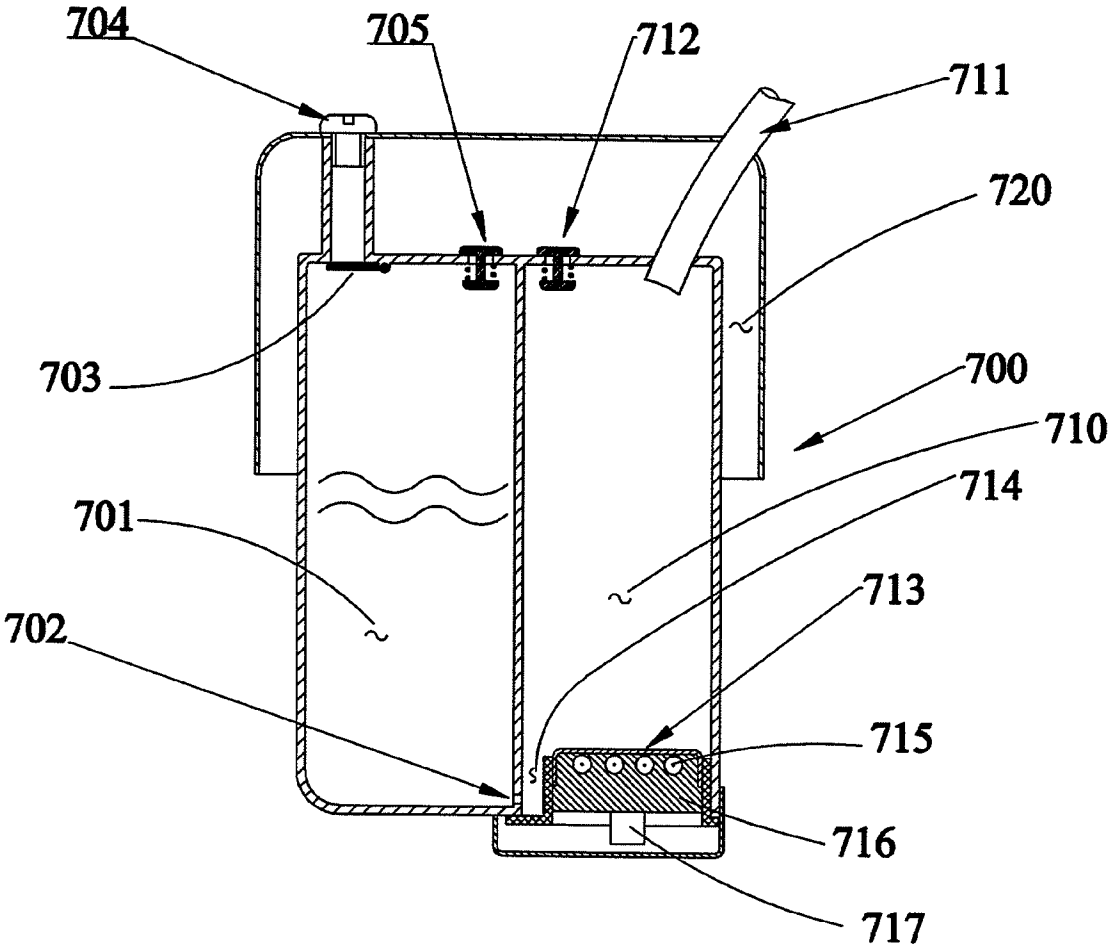
FIG. 18 shows a cross-section view of a steam generator assembly pointing out key components.

An exemplary embodiment of an attractive large volume steam generator is shown in FIG. 18 which is self controlling due to the water being forced back into is storage chamber 701 when steam fills chamber 710 and is not allowed to flow out or be sucked out steam discharge tube 711.

A small water admission port 702 is shown at the bottom wall of the water storage volume 702 into the steam chamber 710 where it first flows into water collection area 714 before over flow on top of the electrically heated stainless steel plate 713.

This steam generator surface is preferably heated by CALROD heating element as shown with a heat sink material 716 such as aluminum surrounding them and in contact with plate 713 and temperature control switch 717. This element can be designed to be removable for cleaning after multiple uses have left any water residue if distilled water is not used. Any suitable heating element, however, may be used.

When the steam fills the chamber the chamber pressure rises pushing the water back through the bleed hole 702 into the storage volume 701 until the water level is down in area 714 into the steam chamber and no longer in contact with the hot plate surface 713 whose temperature can be limited to for example 230° F. No additional steam is generated until water is again allowed to rise in cavity 714 and flood over the hot plate 713.

The bleed hole 702 can be sized so water flow cannot exceed the rate at which the hot plate 713 with its heating elements 715 and heat sink 716 can convert it to steam.

As shown in FIG. 18, the water storage area can have a fill opening and cap 704, which has a pressure closure flap valve 703 so the chamber cannot be filled if there is any pressure. Also, both chambers have a pressure relief valve to overflow chamber 720 where it can be safely vented to atmosphere.

The steam generator and water storage chamber is shown as 19 in FIG. 1 and FIG. 1B. Also shown in FIG. 1B is a possible location for an electric cord reel 200 with spring loaded rewind when button 202 is pushed. A suggested cord exit open is shown at 201.

Since the water at the low vacuum suction pressure may expand as much as 3000 times the water volume converted to steam, a quart of water may produce as much as 3000 quarts of steam that can be used for limited times when the steam trigger is pulled to be the sterilizing, deodorizing, work fluid for dirt pickup.

FIG. 11 shows a flexible sound absorption material in a flat configuration 600 as fabricated before being bent and inserted into the motor suction fan housing as shown in cross-section in FIG. 16.

Figure 17:
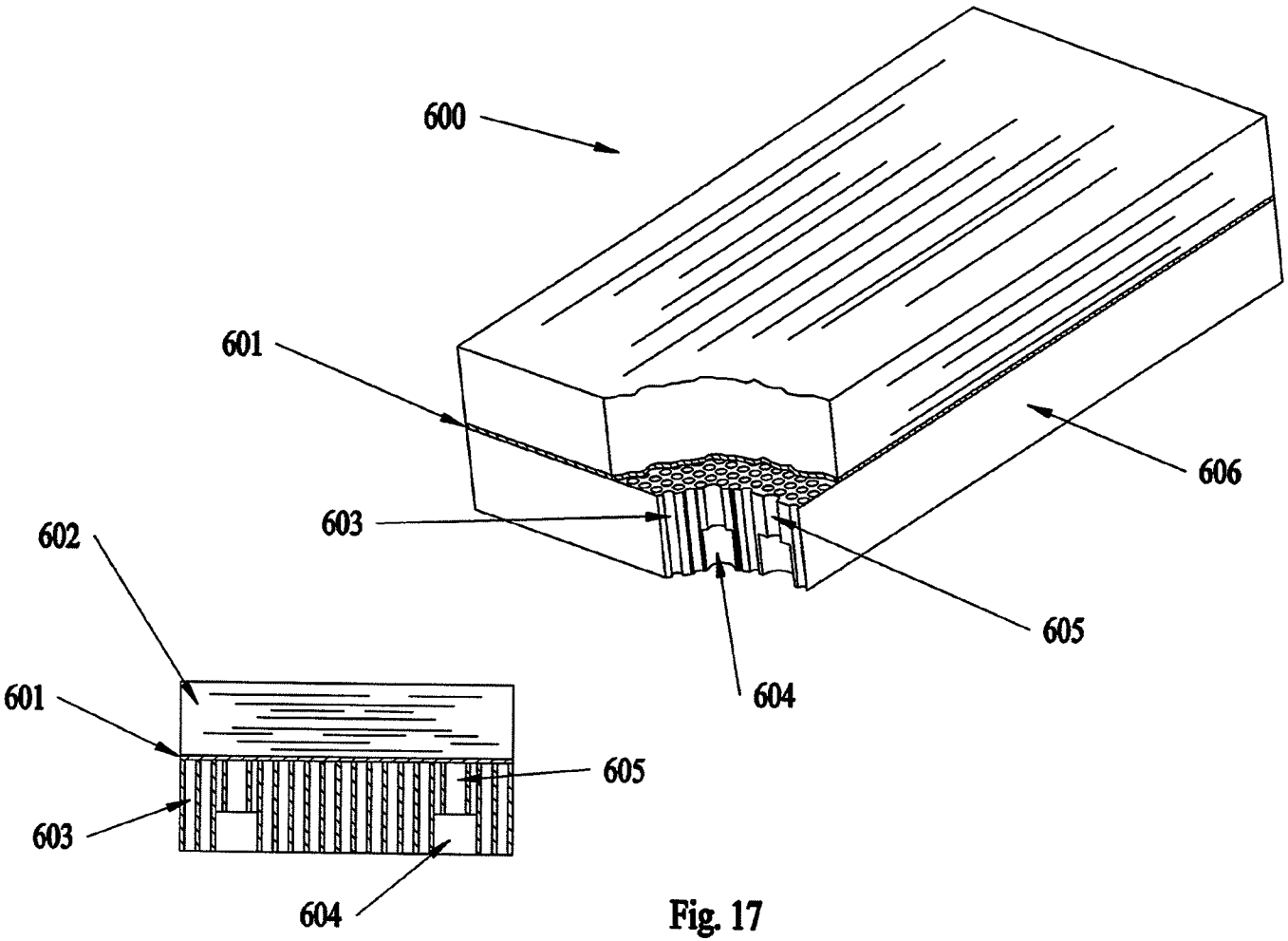
FIG. 17 shows flexible sound absorption material in flat configuration as fabricated before bending and insertion in a motor housing around the suction fan motor assembly in accordance with an embodiment of the present disclosure.

In FIG. 17, the area 606 is sized to be ¼ wavelengths of the predominant higher frequencies of the assembly to generate a complex of honeycomb ¼ wavelengths resonant tubes.

Helmholtz resonant cavities such as shown at 604 with connecting tube opening 605 can be generated as the sound noise profile dictates in the flat molded flexible material identified as 606.

These resonance cavity openings can then be covered by a layer of, for example, felt identified as 601 in FIG. 17 and above that a very open fiberglass fiber material 602 which the vacuum air is discharged through on its way out of the sound suppression motor chambers as shown in FIG. 16 through its exit air discharge area 50.

In FIG. 16 the suction motor and fan area mounted on rubber rings 503 with a rubber spokes support system.

Although the present invention has been described in relation to particular embodiments thereof, many other variations and modifications and other uses will become apparent to those skilled in the art.

What is claimed is:

1. A vacuum device comprising:
- a vacuum head configured to pick up particles via a cleaning fluid;
- a handle connected to the vacuum head and configured to position the vacuum head at desired positions; and
- a housing in fluid communication with the vacuum head, wherein the housing further comprises:
  - a two stage cyclonic separation device configured to separate particles from the cleaning fluid provided from the vacuum head, the two stage cyclonic separation device further comprising:
    - a first stage suction fan configured to propel the cleaning fluid including particles into the two stage cyclonic separation device; and
    - a second stage suction fan, separate from the first stage suction fan and positioned downstream on a discharge side thereof and downstream from the two stage cyclonic separation device drawing air therefrom, the second stage suction fan maintaining negative pressure in the two stage cyclonic separation device, including the area downstream from the first stage suction fan.

2. The vacuum device of claim 1, wherein the two stage cyclonic separation device further comprises:
- first particle separation element shaped to separate particles from the cleaning fluid, wherein the first stage suction fan is positioned in fluid communication with the first particle separation element and configured to blow the cleaning fluid including particles from the vacuum head into the first particle separation element at a high speed to provide high separation force to separate the particles from the cleaning fluid.

3. The vacuum device of claim 2, where in the first particle separation element further comprises:
- a first cyclone chamber having a cylindrical shape with a predetermined diameter, the first cyclone chamber further comprising:
- a tangential inlet positioned on a first longitudinal end of the first chamber and in fluid communication with the first stage suction fan on a discharge side thereof;
- a tangential dirt outlet positioned on a second end of the cyclone chamber, opposite the inlet and configured to direct particles into the particle storage element; and
- a center exit duct mounted in the center of the cyclone chamber having an inlet opening positioned upstream from the tangential dirt outlet.

4. The vacuum device of claim 3, wherein the two stage cyclonic separation device further comprises a first particle storage element, the particle storage element further comprises a first chamber in fluid communication with the tangential dirt outlet such that particles in the fluid exit the first cyclonic chamber via the tangential dirt outlet and are received in the first chamber.

5. The vacuum device of claim 4, wherein the second stage suction fan is in fluid communication with the center exit duct and configured to reduce the density of the cleaning fluid and draw the cleaning fluid substantially without particles out of the first cyclone chamber and maintain negative pressure in the first cyclone chamber.

6. The vacuum device of claim 5, wherein the two stage cyclonic separation device further comprises a plurality of second cyclone chambers, the second stage suction fan aids in drawing the cleaning fluid into the second cyclone chambers and therethrough at high velocity and reducing its density to maximize density difference between the particles and the cleaning fluid.

7. The vacuum device of claim 6, wherein each second cyclone chamber is configured to separate remaining particles from the cleaning fluid and the remaining particles are stored in a separate particle storage chamber.

8. The vacuum device of claim 7, further comprising a HEPA filter, the HEPA filter positioned between the second cyclone chamber and an air discharge of the vacuum device.

9. The vacuum device of claim 7, wherein the first particle separation storage chamber and the separate particle storage chamber are removable from the vacuum device.

10. The vacuum device of claim 7, further comprising a first storage bag provided in the first particle separation storage chamber and a second storage bag provided in the separate particle storage chamber where the first storage bag and the second storage bag are removable from the vacuum device.

11. The vacuum device of claim 10 wherein the first storage bag and the second storage bag are integrated together.

12. The vacuum device of claim 5, wherein the second stage suction fan is configured to maintain the first cyclone chamber, the second cyclone chamber and the first particle separation element below atmospheric pressure.

13. The vacuum device of claim 2, further comprising a sound suppressing material positioned adjacent to the two suction fans and configured to minimize sound of the two suction fans.

14. The vacuum device of claim 13, wherein the sound suppressing material comprises a plurality of resonant tubes and resonant cavities with damping orifices.

15. The vacuum device of claim 14, wherein each resonant tube is configured to have a length corresponding to ¼ of a wavelength of a predominant high frequency of the two suction fans.

16. The vacuum device of claim 2, further comprising a steam generating device configured to provide steam, wherein the steam is provided to the vacuum head as the cleaning fluid to aid in removal of odor particles from the floor.

17. A vacuum device comprising:

a vacuum head configured to pick up particles via a cleaning fluid; and a housing in fluid communication with the vacuum head, wherein the housing further comprises:

a two stage cyclonic separation device, the two stage cyclonic separation device further comprising:

a first stage suction fan configured to propel the cleaning fluid including particles into the two stage cyclonic separation device; and a second stage suction fan, separate from the first stage suction fan and positioned downstream on a discharge side thereof and downstream from the two stage cyclonic separation device to reduce pressure and density of the cleaning fluid and drawing it therefrom, the second stage suction fan maintaining negative pressure in the two stage cyclonic separation device, including the area downstream from the first stage suction fan.

18. A canister type vacuum cleaner comprising:

a vacuum head configured to pick up particles via a cleaning fluid;

a dirt collection container connected to the vacuum head via a dirt collection suction line;

an impeller fan for evacuating the dirt collection container;

a first centrifugal separation chamber in fluid communication with a discharge side of the impeller fan, the first centrifugal separation chamber including:

a tangential inlet in fluid communication with the dirt collection suction line; and a tangential outlet, spaced axially from the tangential inlet;

a second dirt collection chamber in fluid communication with the tangential outlet to store particles separated from the cleaning fluid in the first centrifugal separation chamber; and a high speed suction fan positioned downstream from the second dirt collection chamber exerting suction on fluid flow exiting the first centrifugal separation chamber and directing it into at least one second centrifugal separation chamber and maintaining a pressure lower than atmospheric pressure in the vacuum cleaner, the discharge side of the high speed fan in fluid communication with one of the vacuum head and the atmosphere.

19. A centrifugal separation device comprising:

a cylindrical housing of a predetermined diameter with a tangential inlet positioned on a first longitudinal end and a tangential particle outlet positioned on a second longitudinal end, opposite the tangential inlet, and configured to direct particles out of the cylindrical housing;

a particle storage chamber connected to the tangential particle duct;

a cleaning fluid outlet duct, positioned in the cylindrical housing and coaxial therewith including an inlet opening positioned upstream of the tangential particle outlet a suction fan in fluid communication with the cleaning fluid outlet duct drawing cleaning fluid therefrom and reducing pressure therein and density of the cleaning fluid therein to increase particle separation from the cleaning fluid.

20. The centrifugal separation device of claim 19 further comprising a flow velocity enhancement device configured to increase flow velocity of the cleaning fluid entering the cylindrical housing.

21. The centrifugal separation device of claim 19, further comprising:

a flow velocity enhancement device configured to increase flow velocity of the cleaning fluid entering the cylindrical housing; and a second stage centrifugal separation device positioned in a flow path of the cleaning fluid and in fluid communication with the suction fan.

22. A vacuum cleaner comprising:

a collection chamber in fluid communication with a suction hose connected to a pick-up head, the collection chamber configured to collect cleaning fluid including at least one of particles and liquid from the pick-up head;

a high speed impeller configured to evacuate the collection chamber with an upstream side thereof in fluid communication with the collection chamber;

a first centrifugal separation chamber in fluid communication with a downstream side of the high speed impeller such that the high speed impeller directs the cleaning fluid into the first centrifugal separation chamber at high velocity;

the first centrifugal separation chamber further comprising:

a tangential inlet positioned on one longitudinal end receiving the cleaning fluid from the high speed impeller;

a tangential exit window positioned on a second longitudinal end, opposite the tangential inlet;

a particle collection chamber in fluid communication with the tangential exit window and positioned to collect particles and liquid as the particles and liquid circulate at high velocity around the inner wall of the first centrifugal separation chamber; and a high speed suction fan exerting suction on cleaning fluid leaving the first centrifugal separation chamber to reduce a density of the cleaning fluid and enhance separation of the particles and liquid therefrom and to maintain a low pressure in the entire vacuum cleaner before the cleaning fluid is discharged into the atmosphere or returned to a pick-up head to assist in particle and liquid collection.

* * * * *